US010151074B2

(12) United States Patent
Haupt et al.

(10) Patent No.: US 10,151,074 B2
(45) Date of Patent: Dec. 11, 2018

(54) WAVE DAMPING STRUCTURES

(71) Applicant: Massachusetts Institute of Technology, Cambridge, MA (US)

(72) Inventors: Robert W. Haupt, Lexington, MA (US); Mordechai Rothschild, Newton, MA (US); Vladimir Liberman, Reading, MA (US); Charles G. Doll, Jr., West Newton, MA (US); Shaun R. Berry, Chelmsford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 15/380,999

(22) Filed: Dec. 15, 2016

(65) Prior Publication Data

US 2017/0167100 A1 Jun. 15, 2017

Related U.S. Application Data

(60) Provisional application No. 62/267,390, filed on Dec. 15, 2015.

(51) Int. Cl.
*E04H 9/00* (2006.01)
*E04H 9/02* (2006.01)
(Continued)

(52) U.S. Cl.
CPC ..... *E02D 5/22* (2013.01); *E02B 17/0017* (2013.01); *E04H 9/021* (2013.01); *E04H 2009/026* (2013.01)

(58) Field of Classification Search
CPC ..... E02D 31/08; E02D 27/34; E02D 27/44; E01C 3/06; E04B 1/98; E04B 1/985;
(Continued)

(56) References Cited

U.S. PATENT DOCUMENTS 3,592,147 A * 7/1971 Harper ..... E04H 9/10 109/1 R
3,761,068 A * 9/1973 Suh ..... F16F 7/00 267/136

(Continued)

FOREIGN PATENT DOCUMENTS

CN 102855736 B 6/2014
JP 2015-010367 A 1/2015

OTHER PUBLICATIONS

Achaoui, Y., et al., "Seismic waves damping with arrays of inertial resonators," *Extreme Mechanics Letters*, vol. 8; 30-37 (2016).

(Continued)

*Primary Examiner* — Benjamin F Fiorello
*Assistant Examiner* — Edwin J Toledo-Duran
(74) *Attorney, Agent, or Firm* — Hamilton, Brook, Smith & Reynolds, P.C.

(57) ABSTRACT

A seismic, water, or acoustic wave damping structure can include a structural arrangement of at least two elements, each with an inner volume and containing a medium resistant to passage of an anticipated wave. Example elements can be earth boreholes or water pylons. The structural arrangement can taper from an upper aperture to a lower aperture, the structural arrangement defining a protection zone at the upper aperture. The structural arrangement can be configured to attenuate power from the anticipated wave within the protection zone relative to power from the anticipated wave external to the protection zone. A grouping may include elements that form acute or obtuse angles with a direction of a wave to attenuate wave power. High-value buildings or other structure in a protection zone on land or in water can be substantially shielded from seismic or water waves.

38 Claims, 19 Drawing Sheets

(51) Int. Cl.

| | |
|---|---|
| ***E04B 1/98*** | (2006.01) |
| ***E02D 27/34*** | (2006.01) |
| ***E02D 5/22*** | (2006.01) |
| ***E02B 17/00*** | (2006.01) |

(58) Field of Classification Search

CPC ..... E04H 2009/026; E04H 9/00; E04H 9/02; E04H 9/021; E04H 9/022; E04H 9/023; E04H 9/024; E04H 9/025; E04H 9/027; E04H 9/028; E04H 9/029

USPC ..... 405/302.5, 229, 258, 267, 303; 52/1, 2, 52/167, 167.2, 167.4, 169.1, 169.4, 169.5, 52/169.9, 742, 169.11, 167 R, 573, 396, 52/302.1, 302.3, 750; 238/283, 306, 382

See application file for complete search history.

(56) References Cited

U.S. PATENT DOCUMENTS

| | | | | |
|---|---|---|---|---|
| 4,273,475 | A * | 6/1981 | Fuller | E02D 27/34 405/229 |
| 4,484,423 | A * | 11/1984 | McClure, Jr. | E02D 31/08 52/167.1 |
| 4,508,472 | A | 4/1985 | Handy | |
| 4,707,956 | A * | 11/1987 | Sato | E02D 5/38 52/167.4 |
| 5,174,082 | A * | 12/1992 | Martin | E02D 31/08 405/302.5 |
| 6,139,225 | A * | 10/2000 | Koike | E02D 5/18 37/352 |
| 6,308,135 | B1 * | 10/2001 | Hocking | E02D 3/11 367/60 |
| 6,474,030 | B1 * | 11/2002 | Ueda | E02D 27/14 405/229 |
| 6,659,691 | B1 * | 12/2003 | Berry | E02D 27/14 405/231 |
| 7,234,897 | B2 * | 6/2007 | Conroy | E02D 1/00 405/303 |
| 9,879,401 | B2 * | 1/2018 | Lynch | E02D 5/226 |
| 2002/0108322 | A1 * | 8/2002 | Shreiner | E04B 1/681 52/167.1 |
| 2006/0263152 | A1 * | 11/2006 | Conroy | E02D 1/00 405/303 |
| 2010/0124459 | A1 * | 5/2010 | Slater | A47K 3/10 405/79 |
| 2015/0337518 | A1 | 11/2015 | Bezac | |

OTHER PUBLICATIONS

Alagoz, B. B. and Alagoz, S., "Towards Earthquake Shields: A Numerical Investigation of Earthquake Shielding with Seismic Crystals," *Open Journal of Acoustics*, vol. 1; 63-69 (2011).

Aravantinos-Zafiris, N. and Sigalas, M. M., "Large scale phononic metamaterials for seismic isolation," *Journal of Applied Physics*, vol. 118; 064901 (2015).

Brûlé, S., et al., "Experiments on Seismic Metamaterials: Molding Surface Waves," *Physical Review Letters*, vol. 112; 133901; 1-5 (2014).

Colombi, A., et al., "Directional cloaking of flexural waves in a plate with a locally resonant metamaterial," *Journal of Acoustical Society of America*, vol. 137; 1783 (2015).

Colombi, A., et al., "A seismic metamaterial: The resonant metawedge," *Scientific Reports*, vol. 6; 27717; 1-6 (2016).

Colombi, A., et al., "Forests as a natural seismic metamaterial: Rayleigh wave bandgaps induced by local resonances," *Scientific Reports*, vol. 6; 19238; 1-7 (2016).

Easwaran, V. and Munjal, M. L. "Plane wave analysis of conical and exponential pipes with incompressible mean flow," *Journal of Sound and Vibration*, vol. 152, 73-93 (1992).

Fang, N., et al., "Ultrasonic metamaterials with negative modulus," *Nature Materials*, vol. 5; 452-456 (2006).

Finocchio, G., et al., "Seismic metamaterials based on isochronous mechanical oscillators," *Applied Physics Letters*, vol. 104; 191903; 1-5 (2014).

Guenneau, S. R., et al., "Seismic metamaterials: shielding and focusing surface elastic waves in structures soils," *Journal of Acoustical Society of America*, vol. 136; 2077; Suppl 1; Abstract Only (2014).

Khlopotin, A., et al., "Transformational cloaking from seismic surface waves by micropolar metamaterials with finite couple stiffness," *Wave Motion*, vol. 58; 53-67 (2015).

Kim, S. and Das, M. P., "Seismic Waveguide of Metamaterials," *Modern Physics Letters*, B26; 1250105; 1-4 (2012).

Kim, S. and Das, M. P., "Artificial Seismic Shadow Zone by Acoustic Metamaterials," *Modern Physics Letters*, B27; 1-4 (2013).

Krödel, S., et al., "Wide band-gap seismic metastructures," *Extreme Mechanics Letters*, vol. 4; 111-117 (2015).

Lai, Y., et al., "Hybrid elastic solids," *Nature Materials*, vol. 10; 620-624 (2011).

Liu, Y., et al., "Transformation method to control shear horizontal waves," *International Journal of Applied Mechanics*, vol. 7; 1550049; 1-18 (2015).

Liu, Z., et al., "Locally Resonant Sonic Materials," *Science*, vol. 289; Issue 5485; 1734-1736 (2000).

Milton, G. W. and Willis, J. R., "On modifications of Newton's second law and linear continuum elastodynamics," *Proceedings of the Royal Society A*, vol. 463; 855-880 (2007).

Miniaci, M., et al., "Large scale mechanical metamaterials as seismic shields," *New Journal of Physics*, vol. 18; 083041; 1-14 (2016).

Mitchell, S. J., et al., "Metaconcrete: designed aggregates to enhance dynamic performance," *Journal of Mechanics and Physics of Solids*, vol. 65; 69-81 (2014).

Notification of Transmittal of the International Search Report and the Written Opinion for International Application No. PCT/US2016/066959, entitled: "Elastic Wave Damping Structures," dated Mar. 22, 2017.

Ravilious, K., "Seismic shift: Can we cloak cities from earthquakes?" [online], Jul. 20, 2016 [retrieved Mar. 27, 2017] Retrieved from the Internet URL: https://www.newscientist.com/article/mg23130830-400-seismic-shift-can-we-cloak-cities-from-earthquakes/.

"SPECFEM3D Cartesian" Computational Infrastructure for Geodynamics: Software [online]. [Retrieved Mar. 27, 2017] Retrieved from the Internet URL: https://geodynamics.org/cig/software/specfem3d/.

Wang, Z. G., et al., "Acoustic wave propagation in one-dimensional phononic crystals containing Helmholtz resonators," *Journal of Applied Physics*, vol. 103; 064907 (2008).

Woods, R. D., "Screening of Surface Waves in Soils," *Journal of the Soil Mechanics and Foundations Division*, 1968, vol. 94, Issue 4, p. 951-980.

Zhou, X. and Hu, G., "Analytic model of elastic metamaterials with local resonances," *Phys. Rev.*, B79; 195109 (2009).

Zhu, R., et al., "Microstructure continuum modeling of an elastic metamaterial," *International Journal of Engineering Science*, vol. 49; Issue 12; 1477-1485 (2011).

* cited by examiner

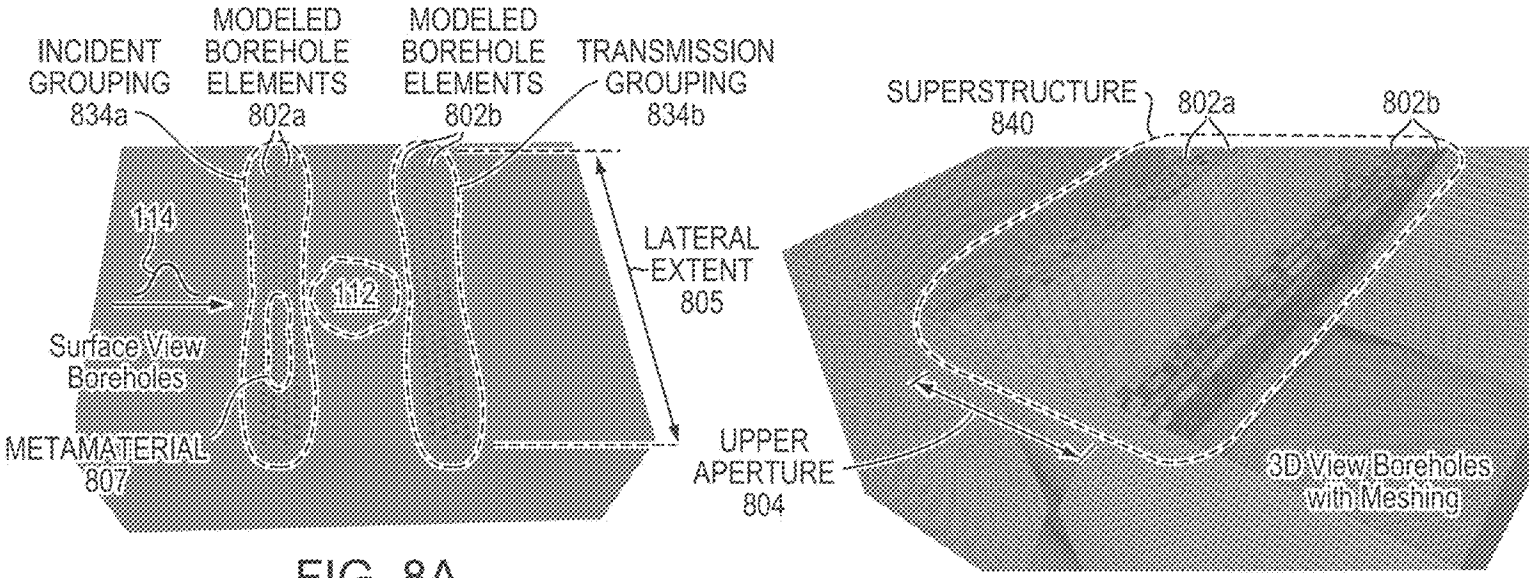
FIG. 8A
FIG. 8B
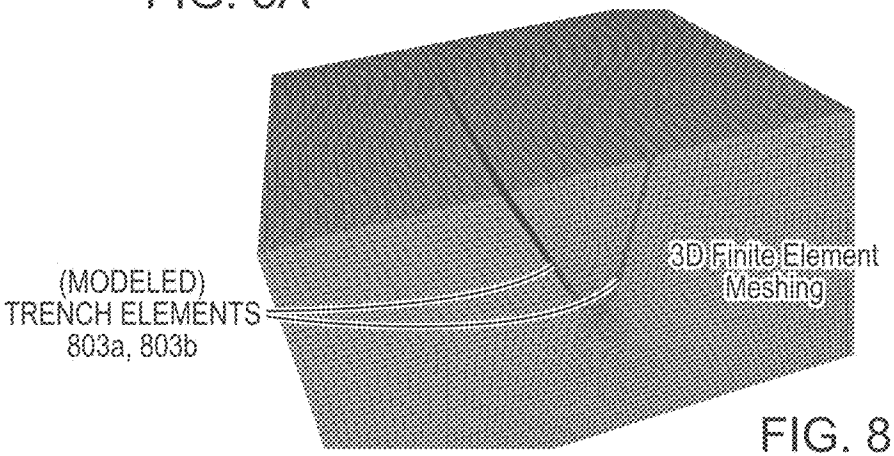
FIG. 8C

EXAMPLE ASSETS AND ESTIMATED SEISMIC CLOAKING STRUCTURE SIZE

| ASSET TO PROTECT IN PROTECTION ZONE | CLOAKING STRUCTURE UPPER APERTURE WIDTH X LATERAL EXTENT | NUMBER OF BOREHOLES |
|---|---|---|
| NUCLEAR POWER PLANT | 200 meters X 500 — 1000 meters | 4,000 — 8,000 |
| AIR VEHICLE RUNWAY | 200 meters X 500 — 1000 meters | 2,000 — 8,000 |
| HOSPITAL | 100 meters X 500 meters — 2 kilometers | 2,000 — 8,000 |
| MILITARY INSTALLATION | 100 meters X 500 meters — 2 kilometers | 8,000 — 40,000 |
| CITY REGION | 50 meters X 5 — 20 kilometers | 10,000 — 40,000 |
| OKLAHOMA PIPELINE | 50 meters X 10 kilometers | 20,000 |

FIG. 10

$$TL_{expansion} = 20\log 10\left[\left[1/2\left(\frac{S_1}{S_2}\right)^{0.5}\right]TL_{11} + \frac{S_2 T_{12}}{\nu} + \frac{T_{21}\nu}{S_1} + \frac{S_2}{S_1}T_{22}\right]$$

$$T_{11} = \frac{z_2}{z_1}\cos(kl) - \frac{\sin(kl)}{kz_1}$$

$$T_{12} = i\frac{\nu}{S_1}\frac{z_1}{z_2}\sin(kl)$$

$$T_{21} = i\frac{S_1}{\nu}\sin(kl)\left(\frac{z_2}{z_1} + \frac{1}{(kz_1)^2}\right) - i\frac{S_1}{\nu kz_1^2}\cos(kl)$$

$$T_{22} = \frac{z_1}{z_2}\cos(kl) + \frac{1}{kz_2}\sin(kl)$$

EASWARAN AND MUNJAL, J. SOUND AND VIBRATION 152 (1992), 73-93

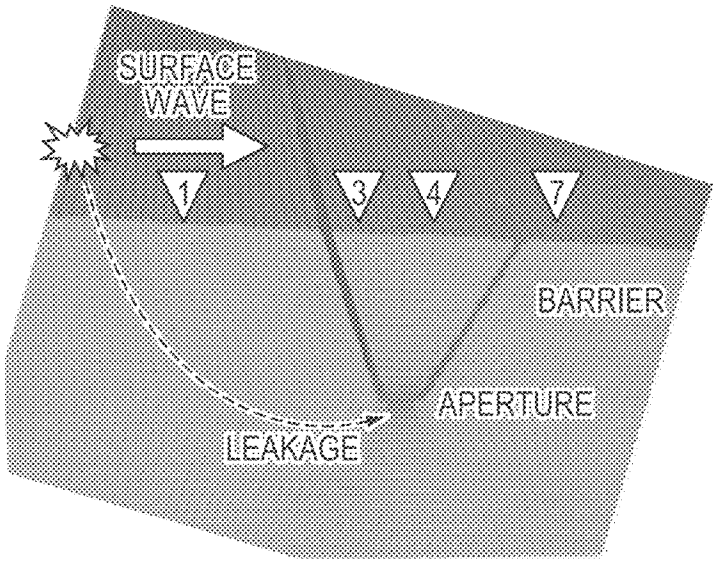
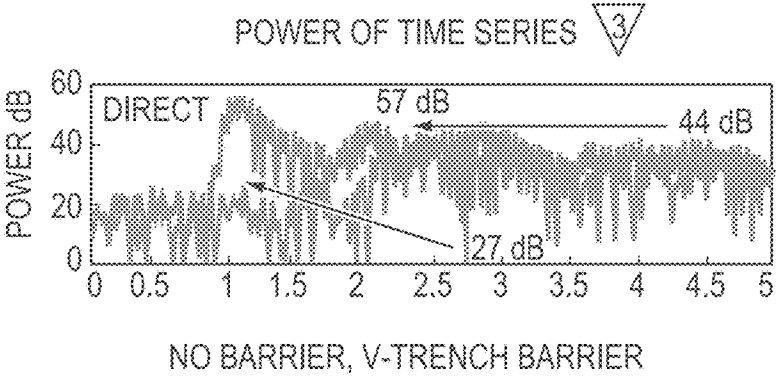
FIG. 15C

EARTHQUAKE MAGNITUDE SCALE, $M_W$

| MAGNITUDE | EFFECTS | NUMBER / YR |
|---|---|---|
| < 2.5 | NOT FELT, BUT RECORDABLE | 900,000 |
| 2.5 — 5.4 | OFTEN FELT, MINOR DAMAGE | 30,000 |
| 5.5 — 6.0 | SLIGHT BUILDING & STRUCTURE DAMAGE | 500 |
| 6.1 — 6.9 | HIGH DAMAGE IN POPULATED AREAS | 100 |
| 7.0 — 7.9 | MAJOR QUAKE - SERIOUS DAMAGE | 20 |
| >8.0 | GREAT QUAKE - HIGHEST DESTRUCTION | 1 in 5 - 10 YRS |

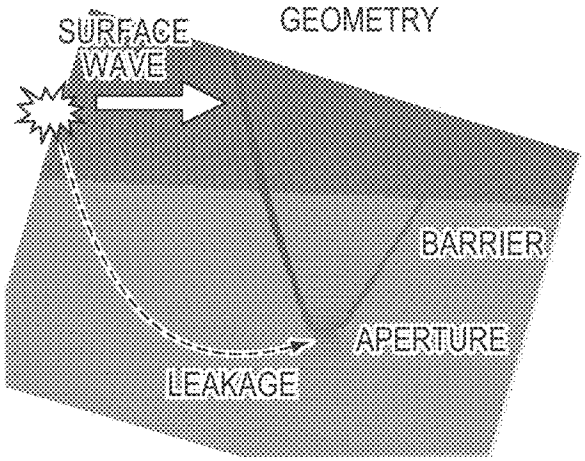

EXTRAPOLATION FROM MEASURED AND MODELED RESULTS (REF TO $M_W$ 7.0 QUAKE)

| | PEAK SURFACE WAVE REDUCTION | | PEAK SURFACE WAVE TO LEAKAGE REDUCTION | |
|---|---|---|---|---|
| | MEASURED | MODELED | MEASURED | MODELED |
| BARRIER STRUCTURE | EFFECTIVE $M_W$ | EFFECTIVE $M_W$ | EFFECTIVE $M_W$ | EFFECTIVE $M_W$ |
| TRENCH - V - BLOCK | - 30-24 dB, 5.4 - 5.0 | - 30-26 dB, 5.3 - 5.0 | - 14-13 dB, 6.2 - 6.1 | - 13-11 dB, 6.3 - 6.2 |
| TRENCH - V - EARTH | | - 43-34 dB, 4.7 - 4.1 | | - 22-21 dB, 5.6 - 5.5 |

FIG. 16

WAVE DAMPING STRUCTURES

RELATED APPLICATION(S)

This application claims the benefit of U.S. Provisional Application No. 62/267,390, filed on Dec. 15, 2015. The entire teachings of the above applications are incorporated herein by reference.

GOVERNMENT SUPPORT

This invention was made with Government support under Contract No. FA8721-05-C-0002 awarded by the U.S. Air Force. The Government has certain rights in the invention.

BACKGROUND

Each year, on average, a major magnitude-8 earthquake strikes somewhere in the world. In addition, 10,000 earthquake-related deaths occur annually, where collapsing buildings claim the most lives, by far. Moreover, industry activity, such as oil extraction and wastewater reinjection, are suspected to cause earthquake swarms that threaten high-value oil pipeline networks, U.S. oil storage reserves, and civilian homes. Earthquake engineering building structural designs and materials have evolved over many years to attempt to minimize the destructive effects of seismic surface waves. However, even under the best engineering practices, significant damage and numbers of fatalities can still occur.

In particular, damage caused by earthquakes to critical structures, such as nuclear power plants, regional hospitals, military installations, airport runways, pipelines, dams, and other infrastructure facilities, exacerbates an earthquake disaster and adds tremendous cost and time of recovery. Even low-energy earthquakes resulting from human activity can cause significant damage. For example, wastewater reinjection practices used by the oil industry resulted in over 900 earthquakes in 2014-2015 in the state of Oklahoma, with a recent 2016 earthquake of magnitude 5.8. These continual earthquakes, although many may be small, can threaten extremely high-value above- and below-ground pipelines that control oil supply, storage, and transport in the U.S. This can present major economic and environmental concerns.

SUMMARY

Earthquake engineering building practices apply primarily to new construction to decouple seismic energy traveling in the ground between the ground and building foundation, whereas existing high-value structures are typically unlikely to be retrofitted because this is cost prohibitive and because there is typically difficulty in accessing the structures. To date, there are no free standing subsurface structures used to protect existing high value assets from incoming hazardous earthquake waves. Recently, a few groups from Europe have been investigating the possibility of using boreholes in front of an area to protect from seismic waves. These efforts have been primarily computer simulations, with one group conducting a small scaled field test. This field test involved using a surface seismic source, which is not representative of a location for an earthquake, because earthquake sources are at depth. This test examined the ability of a few holes to block the seismic energy in its near field. These attempts have been very limited in their usefulness and are not representative of earthquakes, their geometries, raypaths, hypocenters, or seismic wavelengths or amplitudes.

Embodiments described herein can overcome these challenges by providing broadband redirection and attenuation of ground motion amplitudes caused by earthquakes. Embodiments can provide for this by implementing an engineered, subsurface, seismic barrier (elastic wave attenuation structure), for example. In some embodiments, a form of a metamaterial is created. A metamaterial is a material engineered to have a property that is not found in nature. Metamaterials are made from assemblies of multiple elements fashioned from materials not found in the media in which they are embedded. In the case of the earth, boreholes and trenches would be considered metamaterials since they are air-filled or specialized, viscous, attenuating, fluid-filled.

As disclosed herein, a seismic barrier (or metamaterial) can include borehole array complexes or trench complexes that reflect, refract, absorb, divert, or otherwise impede destructive seismic surface waves from a designated "protection zone." Seismic surface waves against which embodiment wave damping structures can protect include Rayleigh waves (ground-roll), shear waves, Love waves, and compressional waves.

Further, embodiment wave damping structures can overcome the limitations of using a vertical borehole structure only in front of an intended protection zone. Use of a vertical borehole structure only in front of an intended protection zone (between a seismic wave incoming toward the protection zone and the protection zone itself) is not effective enough, since most seismic waves will diffract around a vertical borehole structure vertically and still strike the protection area with considerable force. However, as described with respect to embodiments herein, boreholes or trenches (example "elements" as used herein) formed at an angle with respect to the vertical, with lateral offset into the earth and toward a zone and surface structure to be protected, can better divert seismic waves farther away from the intended protection zone than straight, deep boreholes. In addition, embodiment elastic wave damping structures incorporating such borehole or trench elements have been demonstrated, through numerical modeling and bench scale measurements, to provide broadband seismic wave amplitude reduction.

By using angles for holes that point down below a structure to be protected, seismic wave power can be effectively diverted far underneath the structure. Angled holes forming groupings or tapered structures can be particularly helpful due to the vertical depths that surface waves can reach, which can be hundreds of meters or greater. Moreover, by using angled holes on multiple sides of a structure, an aperture between protective holes can be made small, effectively blocking most seismic energy from diffraction toward the protected zone, thereby significantly limiting any need for deep boring, which can be cost-prohibitive. A structural arrangement formed of at least two angled borehole elements with opposing orientations with respect to a vertical, thus forming a tapered aperture, can be referred to herein as a "muffler." Such structures are described hereinafter in greater detail with respect to the drawings.

Furthermore, retrofitting a building area with embodiment wave attenuation structures can be done with much flexibility, because embodiment structures can be implemented farther from a structure, at least at the Earth's surface. Further, certain periodic groupings of boreholes, such as sawtooth-shaped groupings or other geometric groupings, may be employed and can increase a range of seismic wavelengths against which a structure can be made effective. Such layout geometries can advantageously be configured to cause reflected self-interference of a traveling seismic wave, thus reducing the waves's effective ground motion amplitude. Still further, embodiments described herein can be used in protecting areas of the ocean or ocean front from the destructive effects of sea waves, such as tsunamis.

In one embodiment described herein, an elastic wave damping structure includes a structural arrangement of at least two elements, each element defining an inner volume and containing therein a medium resistant to passage of an anticipated elastic wave having a wavelength at least one order of magnitude greater than a cross-sectional dimension of the inner volume of the elements. The structural arrangement can taper from an upper aperture to a lower aperture, the structural arrangement defining a protection zone at the upper aperture, the upper aperture being larger than the lower aperture. The structural arrangement can be configured to attenuate power from the anticipated elastic (e.g., seismic) wave within the protection zone relative to power from the anticipated elastic wave external to the protection zone.

The structural arrangement can be further configured to attenuate power from a Rayleigh wave, or from at least one of a compressional, shear, or Love elastic wave.

The at least two elements can be boreholes in earth, and the upper aperture can be closer to a surface of the earth than the lower aperture. As an alternative, the at least two elements can be trenches in earth, while the upper aperture can still be closer to the surface of the earth than the lower aperture.

The anticipated elastic wave can be a seismic wave in earth, and the medium resistant to passage of the anticipated elastic wave can be air or at least one of a gas, water, or viscous fluid. The anticipated elastic wave can be a water wave, and the medium resistant to passage of the water wave can include a solid material. The upper aperture can be closer to an upper surface of the water in the absence of the anticipated water wave. As an alternative, the upper aperture can be in air, and the lower aperture can be in earth or water in absence of the anticipated water wave.

A depth of the lower aperture in earth or water can be on the order of 100 meters. Each element can further include a structural lining between the inner volume and an exterior of the element. A width of the upper aperture can be on the order of 0.5 km. Particular preferred dimensions for particular upper apertures can be predicted using expressions given hereinafter.

Each of the at least two elements can include a plurality of discreet sub-elements, each of the sub-elements defining a respective sub-element inner volume and containing therein the medium resistant to passage of the elastic wave. Cross-sections of respective discreet sub-elements corresponding to at least one of the elements can be located at points collectively defining a hexagon.

The damping structure can also include a plurality of structural arrangements defining a superstructure, and the protection zone can encompass, at least partially, upper apertures of respective arrangements of the plurality of structural arrangements. The superstructure can be configured to attenuate power from the elastic wave within the protection zone relative to power from the elastic wave external to the protection zone. The protection zone can extend, in length, from one of the at least two elements to the other at the upper aperture. The protection zone can have a width, measured perpendicular to the length, of approximately 5%, 10%, 25%, 50%, 75%, or 100% of the length. The protection zone can be defined by a region, bounded at least partially by the at least two elements, within which the structural arrangement is configured to attenuate power from the elastic (e.g., seismic) wave by at least 10 dB in power within the protection zone relative to power from the elastic wave external to the protection zone. Larger reductions in power have also been demonstrated by the authors using numerical simulations and scaled measurements.

The damping structure can also include an incident grouping of elements situated at a border of the protection zone expected to receive the elastic wave, as well as a transmission grouping of elements situated at a border of the protection zone opposite the incident grouping. The structural arrangement of at least two elements can include one element of the incident grouping and one element of the transmission grouping. Each element of the incident and transmission groupings of elements can have upper and lower ends thereof, and each element of the incident and transmission groupings of elements can define an inner volume and contain therein the medium resistant to passage of the anticipated elastic wave. The incident and transmission groupings can form a superstructure.

Upper ends or lower ends of respective elements of the incident or transmission grouping may be situated along an element row. Upper ends or lower ends of respective elements of the incident or transmission grouping may further be situated along a plurality of substantially parallel rows to form an element array. Upper ends or lower ends of respective elements of the incident or transmission grouping may be situated to form a substantially periodic pattern. The substantially periodic pattern may be a substantially sawtooth pattern, or the pattern may be configured to cause constructive or destructive interference of diffracted portions of the anticipated elastic wave diffracted from respective elements.

The damping structure can also include an electro-mechanical generator configured to generate or store electrical power using mechanical power from the anticipated elastic wave.

In another embodiment, an elastic wave damping structure may include a structural grouping of elements, each element of the structural grouping defining an inner volume and containing therein a medium resistant to passage of an anticipated elastic wave having a wavelength at least one order of magnitude greater than a cross-sectional dimension of the inner volume of the elements. Each element of the structural grouping may have an upper end and a lower end thereof defining a first line from the upper end to the lower end. The first line can form an acute angle with a second line defining a direction of travel of the anticipated elastic wave toward a protection zone. The structural grouping of elements may be configured to attenuate power from the elastic wave within the protection zone relative to power from the elastic wave external to the protection zone.

The grouping of elements can be further configured to attenuate power from a Rayleigh elastic wave, or from at least one of a compression, shear, or Love elastic wave. Each element may be a borehole in earth or a trench in earth, with the upper end closer to a surface of the earth than the lower end.

At least one of the elements can include a plurality of discreet sub-elements substantially parallel to each other, each of the sub-elements defining a respective sub-element inner volume and containing therein the medium resistant to passage of the elastic wave. Cross-sections of respective discreet sub-elements may be located at points in a cross-sectional plane collectively defining a hexagon.

Upper ends or lower ends of respective elements can be situated along an element row. Furthermore, upper ends or lower ends of respective elements can be situated along a plurality of substantially parallel rows to form an element array. Upper ends or lower ends of respective elements can be situated to form a substantially periodic pattern, and the substantially periodic pattern may be a substantially sawtooth pattern. The substantially periodic pattern may also be configured to cause constructive or destructive interference of diffracted portions of the anticipated elastic wave diffracted from respective elements.

The grouping of elements can be an incident grouping of elements situated at a border of the protection zone at which the anticipated elastic wave is expected to be incident. The damping structure can further include a transmission grouping of elements situated at an opposite border of the protection zone opposite the incident grouping. Each element of the transmission grouping can define an inner volume and contain therein a medium resistant to passage of the anticipated elastic wave having a wavelength at least one order of magnitude greater than a cross-sectional dimension of the inner volume of the element. Each element of the transmission grouping may have an upper end and a lower end thereof defining a first line from the upper end to the lower end, the first line forming an obtuse angle with a second line defining a direction of travel of an attenuated anticipated elastic wave away from the protection zone. The transmission grouping of elements can be configured to attenuate power from the elastic wave within the protection zone relative to power from the elastic (e.g., seismic) wave external to the protection zone and transmitted through or around the incident grouping of elements.

A separation of upper ends of elements of the incident grouping from upper ends of respective elements of the transmission grouping can be on the order of 0.5 km. The protection zone can be further defined by a region, bounded at least partially by the incident and transmission groupings, within which the incident and transmission groupings are configured to attenuate power from the elastic wave by at least 10 dB within the protection zone relative to power from the elastic wave external to the protection zone.

In yet another embodiment, an elastic wave damping structure can include first means for damping an anticipated elastic wave and second means for damping an anticipated elastic wave, wherein a combination of the first means and the second means forms an upper aperture and a lower aperture. The upper aperture can taper to lower aperture, the combination defining a protection zone at the upper aperture. The structural arrangement can be configured to attenuate power from the anticipated elastic wave within the protection zone relative to power from the anticipated elastic wave external to the protection zone.

In still another embodiment, an elastic wave damping structure can include first means configured to attenuate power from an anticipated elastic wave and at least one second means configured to attenuate power from the elastic wave. Each of the first and second means can define a first line from an upper end of the means to a lower end of the means, the first line forming an acute angle with a second line defining a direction of travel of the anticipated elastic wave toward a protection zone.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 8A is a top-view illustration of a protection zone formed between modeled arrays of borehole elements.

FIG. 8B is a three-dimensional (3D) illustration of the protection zone and borehole elements shown in FIG. 8A.

FIG. 8C is a 3D view of modeled trench elements in a 3D finite element meshing.

FIG. 10 is a table showing various high-value assets that may be protected, as examples, using embodiment elastic wave damping structures, with expected upper aperture and lateral extent sizes and numbers of boreholes for corresponding structures.

FIGS. 15A-15C show measured results that illustrate the effects of a model V-trench machined in Delrin® block table-top experimental configuration. In particular, FIG. 15A and FIG. 15B show accelerometer time series traces measured in a center line across a homogeneous solid Delrin® block relative to the transducer source location, and FIG. 15C shows the model trench barrier structure in schematic form, along with accelerometer locations corresponding to the traces in FIGS. 15A-15B.

FIG. 16 shows earthquake magnitude reduction expected due to subsurface barrier structures, based on extrapolation from the measured and modelled results.

DETAILED DESCRIPTION

A description of example embodiments of the invention follows.

Figure 1A:
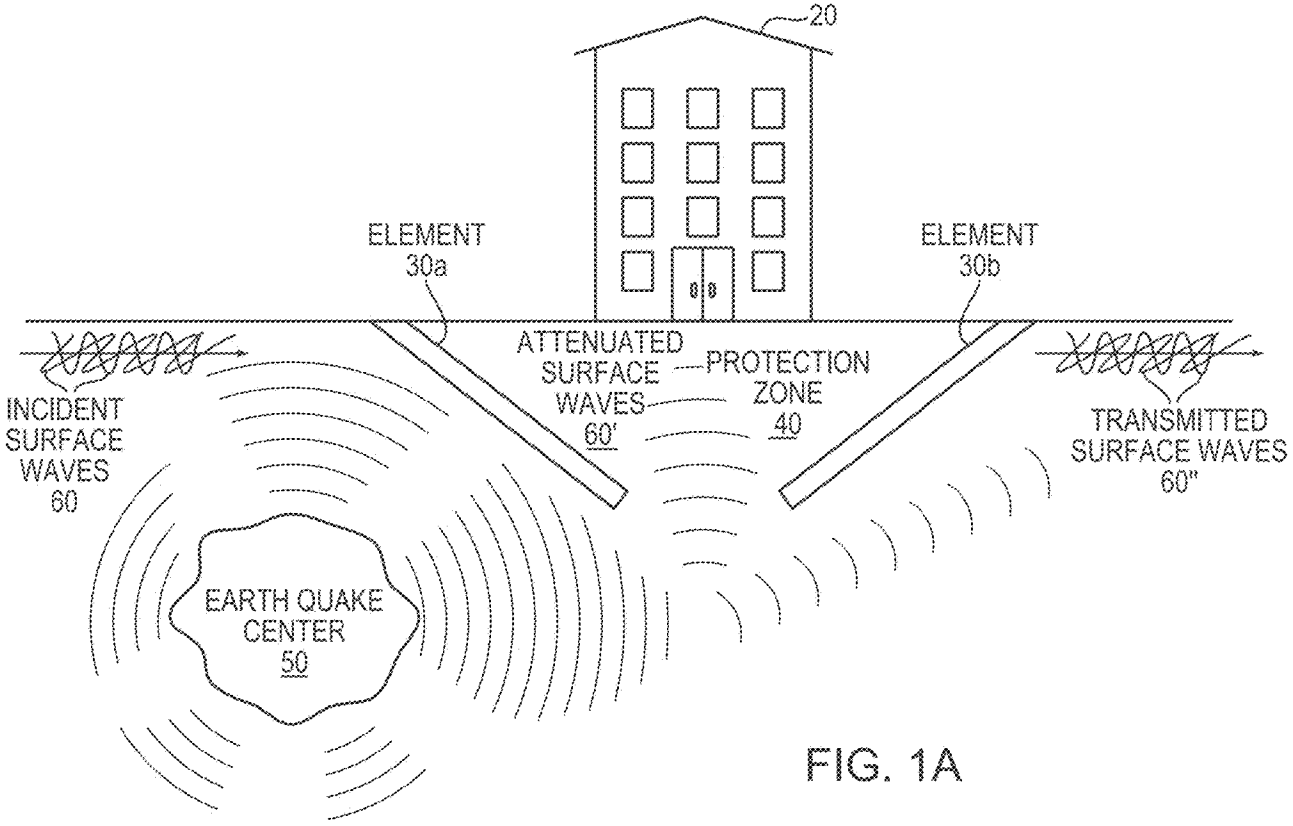
FIG. 1A is a cross-sectional side view of an embodiment elastic wave damping structure that includes a downward-tapered, V-shaped structural arrangement with two elements.

FIG. 1A is a cross-sectional side view of an embodiment elastic wave damping structure that includes a downward-tapered, V-shaped structural arrangement with two elements 30*a* and 30*b*. The structural arrangement defines a protection zone 40 between the elements 30*a* and 30*b*, where a building 20 that is desired to be protected is located above the protection zone. The damping structure is configured to protect the building 20 from incident surface waves 60 that initially impinge on the element 30*a* as a result of an earthquake 50. A small amount of seismic wave power still enters the protection zone 40, such that there are attenuated surface waves 60' under the building 20. Some wave energy also travels underneath and around the elements 30*a* and 30*b* to become transmitted surface waves 60".

Figure 1B:
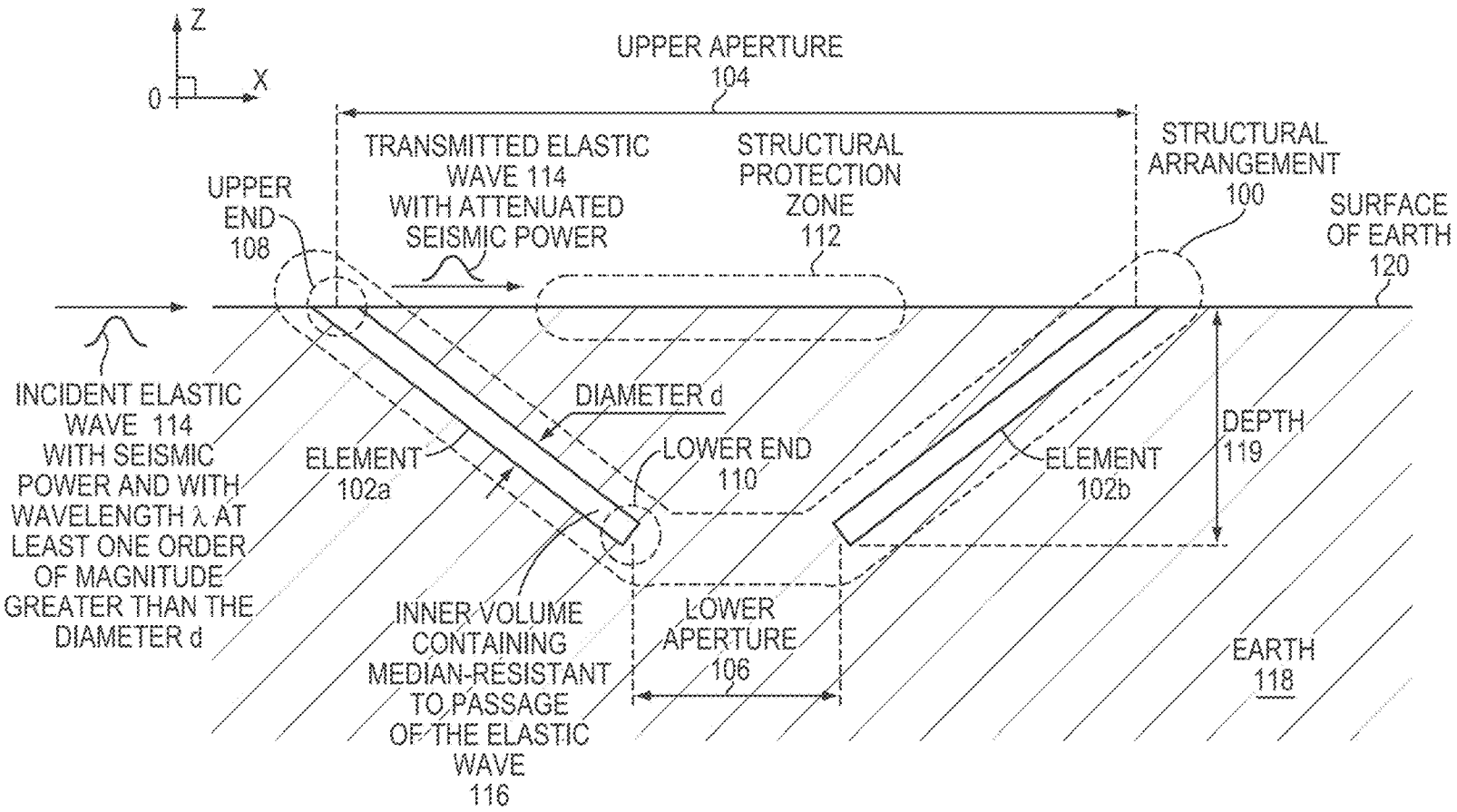
FIG. 1B is a diagram of the embodiment of FIG. 1A without the above-ground building structure and with additional below-ground details as compared to FIG. 1A.

FIG. 1B is a cross-sectional side view of an embodiment elastic wave damping structure that includes a structural arrangement 100 with two elements 102*a* and 102*b*. Each of the elements 102*a* and 102*b* defines an inner volume 116 that contains therein a medium resistant to passage of an anticipated incident elastic wave 114. The wave 114 has a wavelength at least one order of magnitude greater than a cross-sectional dimension of the inner volume of the elements, such as the diameter d of the element 102*a*. The element 102*a* may be referred to as having an upper end 108 and a lower end 110. Likewise, while not marked in FIG. 1B, the element 102*b* has upper and lower ends similar to those of element 102*a*.

The structural arrangement 100 tapers from an upper aperture 104 to a lower aperture 106. The structural arrangement 100 defines a protection zone, also referred to herein as a "structural protection zone" 112, at the upper aperture 104. The structural arrangement 100 is configured to attenuate power from the anticipated, incident elastic wave 114 within the protection zone 112, relative to power from the anticipated elastic wave external to the protection zone. Thus, outside of the protection zone 112, the incident elastic wave 114 has a given power, which can be referred to as seismic power, where the elastic wave 114 propagates in earth 118. However, due to the attenuation of power within the protection zone 112, which is caused by the structural arrangement 100, a component 114' of the elastic wave 114, which is transmitted into the protection zone 112, has an attenuated seismic power relative to the incident elastic wave 114 that is incident at the structural arrangement 100. In particular, the elastic wave 114 is incident at the element 102*a* of the structural arrangement 100.

The upper ends of the elements 102*a* and 102*b* are located at greater (more positive) Z values along the Z axis that is illustrated in FIG. 1B, while the lower ends 110 are located at smaller positive (more negative), Z values than the upper ends 108.

The structural arrangement 100 can be configured to attenuate power from a Rayleigh wave, or from at least one of a compressional, share, or love elastic wave. Thus, where the elastic weight 114 is a seismic wave, for example, the structural arrangement 100 is, advantageously, effective for attenuating surface seismic waves, as well as seismic waves of other types.

Figure 2A:
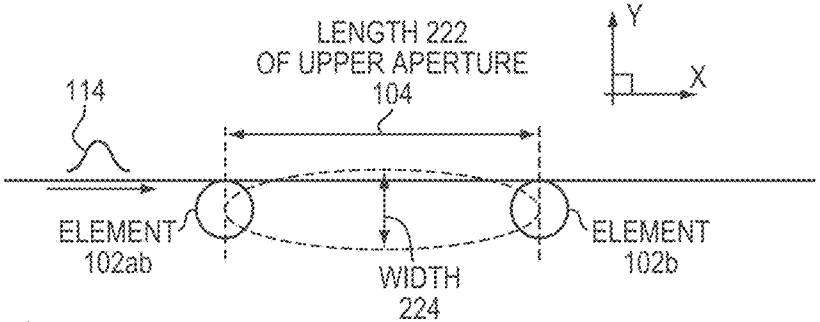
FIG. 2A is a top-view illustration of the structural arrangement of FIG. 1B.

The elements 102*a-b* can be boreholes in earth, and, as described hereinabove, the upper aperture 104 can be closer to a surface 120 of the earth 118 than the lower aperture 110. However, in other embodiments, the two elements 102*a* and 102*b* can be trenches in the earth 118, as described hereinafter in connection with FIG. 2F. For either boreholes or trenches, or other configurations of the elements 102*a-b*, the upper aperture 104 can be closer to a surface 120 of the earth 118 than the lower aperture 110, as illustrated in FIG. 1B. The lower aperture 110 is at a depth 119 in the earth below the surface 120. In many embodiments, the length of the upper aperture, as also illustrated in FIG. 2A and described below, can be on the order of 0.5 km, for example.

Furthermore, continuing to refer to FIG. 1B, in cases where the anticipated incident elastic wave 114 is a seismic wave in the earth, the medium contained in the inner volume 116 and resistant to passage of the wave 114 can be air, for example. However, in other embodiments, the medium contained in the inner volume 116 can be at least one of a gas, water, or viscous fluid. In all of these cases of air, gas, water, or viscous fluid, for example, the medium does not transmit seismic power nearly as well as the earth 118. Hence, the medium resists passage of the wave 114, and seismic power can be deflected, reflected, diffracted, or otherwise dissipated before it enters the protection zone 112 as the attenuated wave 114 with attenuated seismic power. Moreover, given the tapered shape of the structural arrangement 100, which can also be considered to be angles of the elements 102*a* and 102*b* with respect to the z-axis, seismic power can be directed downward, away from any structures or objects desired to be protected within the structural protection zone 112.

The limited-size, lower aperture 106 helps to prevent leakage of seismic power around the element 102*a*, at which the seismic wave 114 is incident, and up to the protection zone. Such leakage presents some limitation on the effectiveness of the element 102*a* as a seismic shield; however, it should also be recognized that, in other embodiments, such as that illustrated in FIGS. 4B and 5-7, a grouping of elements, such as the element 102*a*, may still be advantageously used on an incident side of the structural protection zone 112 in order to limit seismic power reaching the protection zone. Thus, while the element 102*b* on the side of the protection zone opposite the incident side causes the structural arrangement 100 to be much more effective, embodiments can nevertheless employ an array of elements 102*b* on the incident side of the protection zone, where the elastic wave 114 is expected to be incident, with some helpful attenuation and deflection of seismic power reaching the protection zone.

The structural arrangement 100 illustrates a key feature of many embodiments, the ability to be effective in broadband shielding against a wide range of seismic wavelengths. In particular, broadband wavelengths longer than the lower aperture 106 are most effectively blocked by the structural arrangement 100. While higher frequency, shorter wavelength seismic waves with wavelengths shorter than the lower aperture 106 are not as effectively shielded by the arrangement 100, the majority of seismic power is typically present at the very low frequencies and longer wavelengths that are less able to enter through the lower aperture.

FIG. 2A is a top-view of the structural arrangement 100 illustrated in FIG. 1B, viewing the X-Y plane, down along a line of sight following the Z-axis illustrated in FIG. 1B. As illustrated in FIG. 2A, a length 222 of the upper aperture 104 can be considered to extend the entire length between the upper end of the element 102*a* and the upper end of the element 102*b*. This is because, between the elements 102*a* and 102*b*, there is some degree of attenuation of the incident wave 114 at all points, even though the attenuation can vary. Although the cross-sectional profiles of the elements 102*a* and 102*b* are round, it should be understand that cross-sectional profiles of elements in other embodiments may have any shape, such as oval, rectangular, or any other shape. However, if drilling is used to form the elements, it is likely most convenient to bore out elements with circular cross sections.

The protection zone 112 can also have a width 224 that can extend, measured perpendicular to the length 222, approximately 5%, 10%, 25%, 50%, 75%, or 100% of the length 222, for example the region defined as the protection zone 112 can also be defined in terms of a particular degree of attenuation of the seismic waves 114 that can be achieved. For example, the protection zone 112 can be defined by a region, bounded by at least partially by the elements 102*a* and 102*b*, within which the structural arrangement 100 is configured to attenuate power from the elastic wave 114 by at least 10 dB. This attenuation can be within the protection zone 112, relative to power from the elastic wave 114 external to the protection zone 112. Furthermore, other criteria can be used to select the protection zone, such as the region within which a 3 dB attenuation of seismic power is obtained, or within which more than another given value, such as more than 30 dB of attenuation is obtained, for example.

Figure 2C:
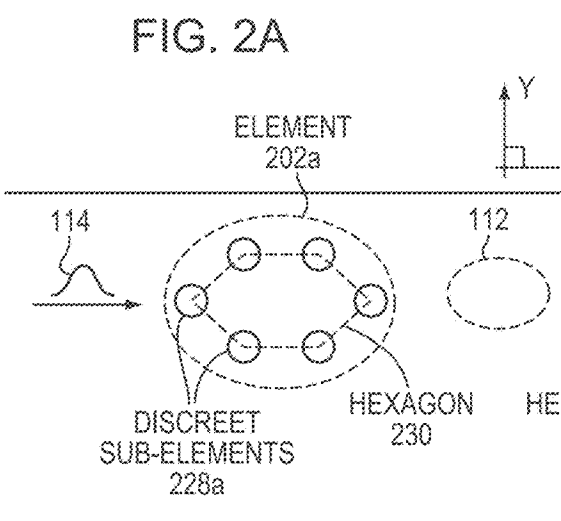
FIG. 2C is a top-view illustration of an embodiment elastic wave damping structure including an arrangement of two elements formed of pluralities of discrete sub-elements in hexagonal clusters.
Figure 2B:
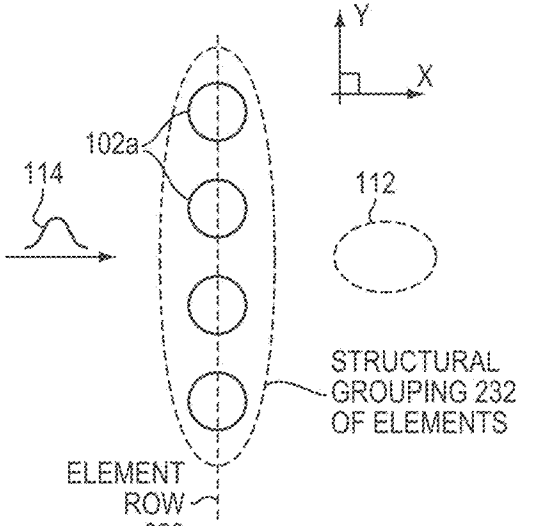
FIG. 2B is a top-view illustration of a linear structural grouping of elements forming an embodiment elastic wave damping structure.

FIG. 2B illustrates that a structural arrangement can have more than just two elements, such as the elements 102*a* and 102*b* in FIG. 1B and FIG. 2A. In particular, four elements 102*a* are oriented along a line (element row) 226, in the direction of the y-axis, between the incident wave 114 and the protection zone 112. The four elements 102*a* form a structural grouping 232 of elements. Because these elements are on a side of the production zone 112 that is expected to receive the incident seismic wave 114, the structural grouping 232 can be referred to as an "incident" structural grouping of elements.

FIG. 2C is a top view of two elements 202*a* and 202*b*. The element 202*a* is formed of a plurality of discrete sub-elements 208*a*. The discrete set of elements 208*a* can be smaller than the element 102*a* in FIG. 1B, or they may be of the same size as element 102*a*. The element 202*a* forms a cluster with the sub-elements situated to increase structural strength. In particular, in FIG. 2C, the sub-elements 228*a* are located such that cross-sections of the respective sub-elements 208*a* corresponding to the element 202*a* are located at points collectively defining a hexagon 230. Similarly, the element 202*b* is formed of discrete sub-elements 208*b* located at points defining the hexagon 230. The cross sections illustrated in FIG. 2C are located in a cross-sectional plane that is the X-Y plane shown in FIG. 2C. However, another example cross-sectional plane in which the elements can be located at points forming a hexagon is a plane perpendicular to the elements 202*a*, which do not extend downward along the Z axis.

As is understood in the art of mechanical engineering, the hexagon formation for structural elements can be particularly strong. However, it should be understood that discrete sub-elements can be arranged in other orientations, such as in groups of four, in pentagon or other polygon shapes, or in other arrangements, for example.

Figure 2E:
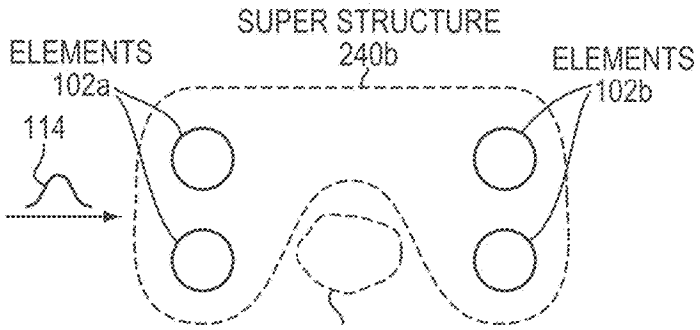
FIG. 2E is a top-view illustration of an embodiment wave damping structure including a superstructure with two of the structural arrangements illustrated in FIG. 1B.
Figure 2F:
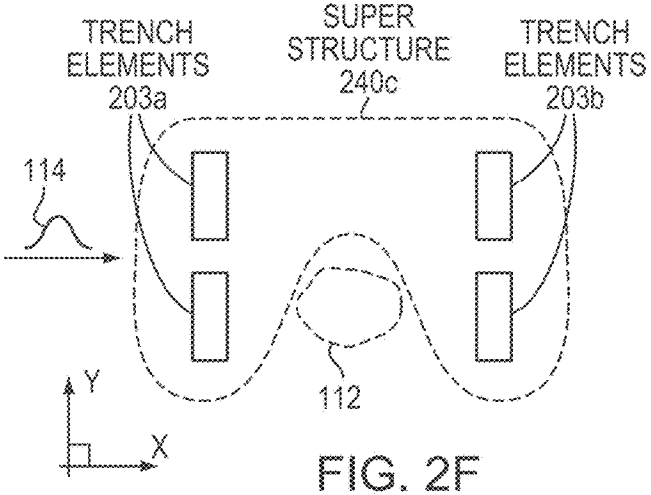
FIG. 2F is a top-view illustration of a superstructure includes trench elements instead of borehole elements.
Figure 2D:
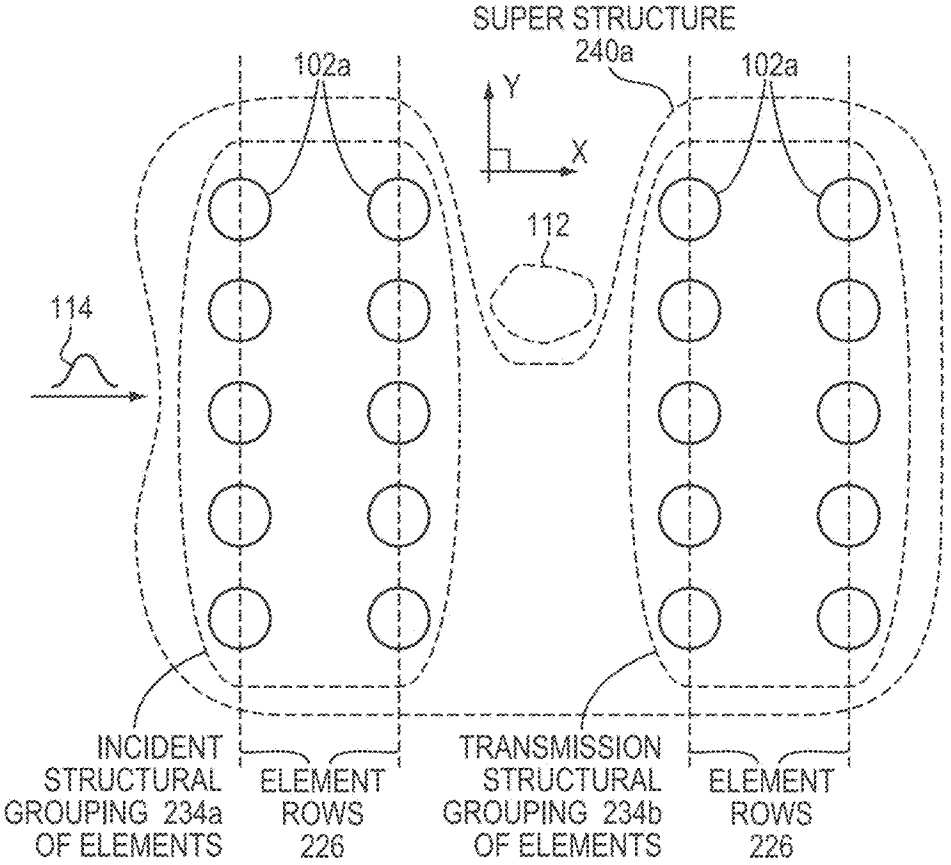
FIG. 2D is a top-view illustration two structural groupings of elements, namely an incident structural grouping to 304*a* of elements that are arranged into substantially parallel element rows 226 on the incident side of the protection zone.

FIGS. 2D-2F illustrate other embodiment arrangements of elements. In particular, the arrangements illustrated in the top-view illustrations of FIGS. 2D-2F, in which there are a plurality of structural arrangements, constitute other example orientation patterns.

FIG. 2D, in particular, illustrates two structural groupings of elements, namely an incident structural grouping to 234*a* of elements that are arranged into substantially parallel element rows 226 on the incident side of the protection zone 112, which is the side at which the anticipated seismic wave 114 is anticipated to arrive toward the protection zone. Similarly, at the opposite side of the protection zone 112, the superstructure 240*a* includes two additional, substantially parallel element rows 226 of elements 102*b* that include a transmission structural grouping 234*b* of elements, at the side of the protection zone 112 that receives seismic power transmitted (leaked) through the protection zone 112. The elements 102*a* on the incident side, in the incident structural grouping 234*a*, and corresponding elements on the transmission side, in the transmission structural grouping 234*b*, form respective, structural arrangements similar to the arrangement 100 shown in FIG. 1B.

The element rows of the respective groupings that are closest to the protection zone 112 may be considered to form respective structure arrangements, while the remaining, outer rows can be considered to form respective wider structural arrangements. However, alternatively, an inner row from one grouping may be considered to correspond to an outer row from the opposite grouping, and vice versa, such that all structural arrangements have similar aperture sizes.

As can also be seen in FIG. 2D, the protection zone 112 encompasses, at least partially, upper apertures of respective structural arrangements. It should be noted that, while the elements 102*a* and 102*b* each form regular, periodic arrays of elements, in other embodiments, the elements 102*a* and 102*b* can each have other formations, and do not need to be situated in element rows. Furthermore, it should be understood that, in other superstructures within the scope of the present disclosure, there can be unequal numbers of elements in an incident structural grouping and a transmission structural grouping. In particular, respective incident-side elements and transmission-side elements can still form upper apertures of one or more respective, structural arrangements, similar to that shown in FIG. 1B.

FIG. 2E is a top-view illustration of a superstructure 240*b* that includes two structural arrangements. In particular, one structural arrangement is formed by a first of the elements 102*a* and a first of the elements 102*b*, while a second structural arrangement similar to that shown in FIG. 1B is formed by a second of each of the groupings 102*a* and 102*b* of elements.

FIG. 2F is a top-view illustration of a superstructure 240*c* that includes trench elements 203*a* and 203*b*. In particular, the top view in FIG. 2F shows that the trenches 203*a* and 203*b* are not boreholes, but instead are substantially rectangular in their cross-sectional profiles. Each of the trench elements 203*a-b* defines an inner volume in the earth, filled with a medium that resists transmission of the seismic wave 114 toward the protection zone 112. Furthermore, one pair of the trench elements 203*a-b* forms a structural arrangement similar to the arrangement 100 in FIG. 1B, while a second pair of the elements 203*a* and 203*b* forms a second structural arrangement. The trench elements 203*a* and 203*b* form two separate structural arrangements, with respective upper and lower apertures, similar to the upper and lower apertures, 104 and 106, respectively, in FIG. 1B, for example.

Figure 3:
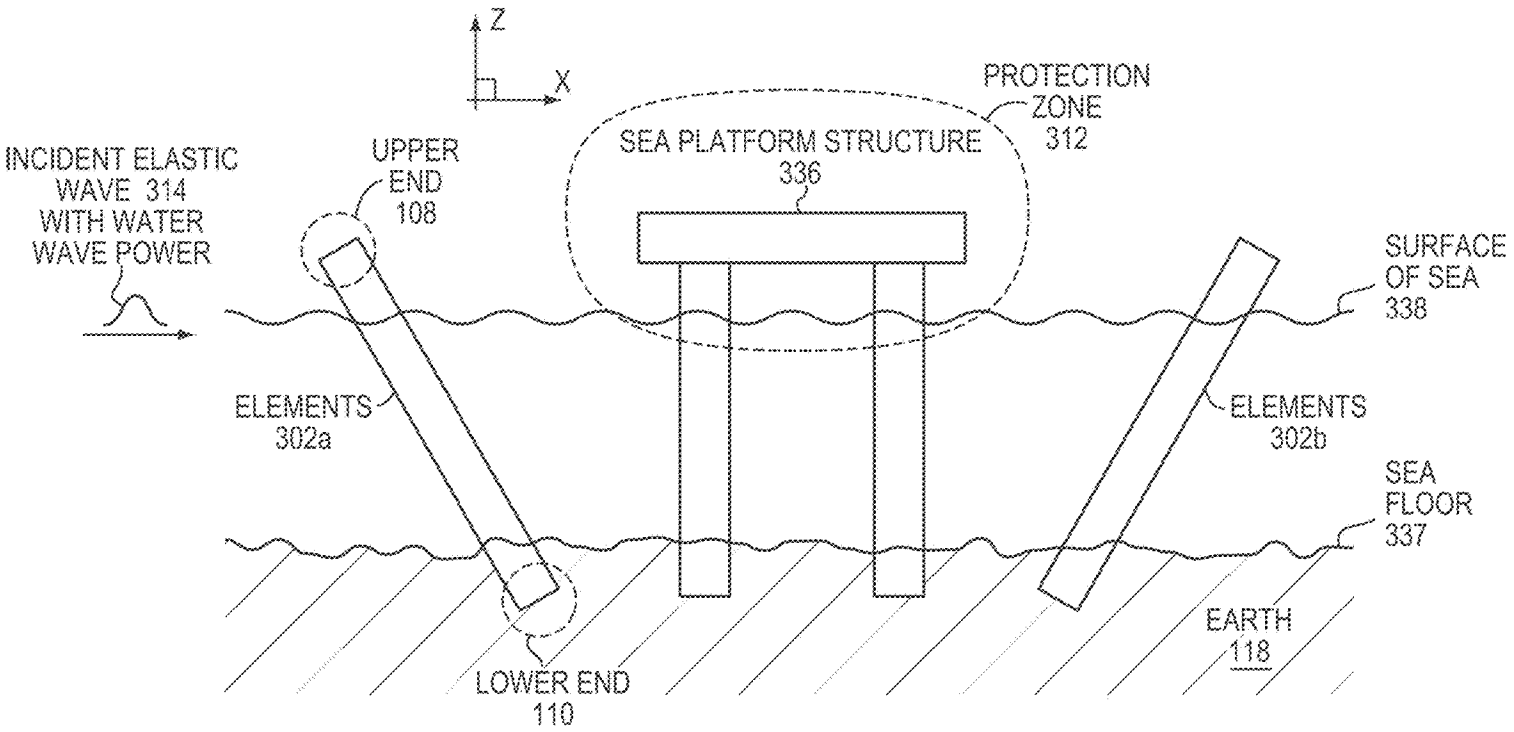
FIG. 3 is a cross-sectional side-view diagram showing how embodiments can be advantageously used to protect structures in the sea, such as an oil platform.

FIG. 3 is a cross-sectional side-view diagram showing how embodiments can be advantageously used to protect structures in the sea, such as a sea platform structure 336. The platform 336 stands above a surface 338 of the sea, while legs of the platform are anchored into the earth 118 below the seafloor 337. It is desirable to protect the sea platform 336, which can include an oil rig or other structure in the sea, by forming a protection zone 312 around the platform.

In FIG. 3, the protection zone 312 is formed at the upper aperture of elements 302*a* and 302*b*. The elements 302*a-b* are anchored into the earth 118 at their respective lower ends 110, while their upper ends 108 extend above the sea surface 338. In other embodiments, the lower ends 110 of the elements 302*a-b* are not anchored into the earth, but instead, the elements 302*a-b* are suspended mechanically, such that they extend only a certain distance below the surface 338 of the sea. In either case, the elements 302*a-b* redirect power from an incident elastic, water wave that would otherwise be expected to be incident at the sea platform 336 in its full strength.

The elements 302*a-b* each form an inner volume containing therein a medium resistant to passage of the wave 314. For the case of water waves, this material can be a solid, for example. In this way, the elements 302*a-b* may be formed of wood, metal, or another structure. The elements 302*a-b* can be similar to pylons, for example.

It should be understood that embodiment elastic wave damping structures that are used to protect against water waves are not limited to a single structural arrangement, such as the one shown in FIG. 3. In other embodiments, any one of the groupings of arrangements or discrete sub-elements that are illustrated in FIGS. 2B-2F may be used to protect against water waves, for example. Furthermore, in some embodiment wave damping structures, only a plurality of elements 302*a* on the incident side of the protection zone are used, such that they form an incident structural grouping. Furthermore, as described hereinafter in connection with FIG. 4B, for example, structural groupings of elements can be used to protect against damaging water waves expected to be incident on land, such as tsunami waves.

Figure 4A:
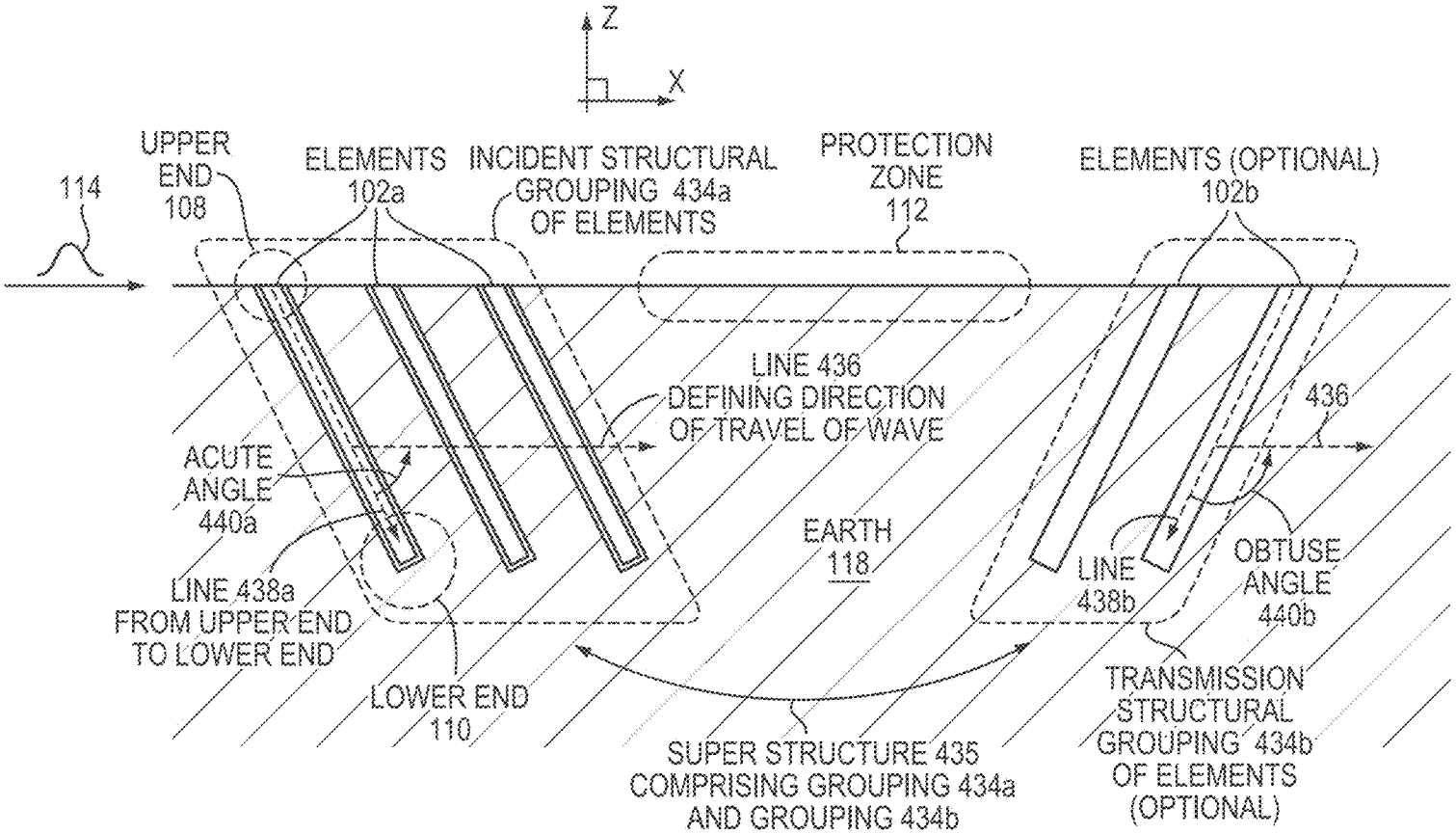
FIG. 4A is a cross-sectional, side-view illustration of incident and transmission structural element groupings, respectively, of elements on either side of a protection zone.

FIG. 4A is a cross-sectional, side-view illustration of incident and transmission structural groupings 434*a* and 434*b*, respectively, of elements on either side of a protection zone 112. The incident structural grouping 434 includes three elements 102*a* on the incident side of the protection zone 112. Each of the elements 102*a* has the upper end 108 and the lower end 110, similar to the elements described in connection with FIG. 1B. Each element 102*a* defines a line 438*a* extending from the upper end 108 to the lower end 110. This line forms an acute angle 440*a* (less than 90°) with a line 436 that defines a travel direction of the wave 114 toward the protection zone.

A grouping of two or more of the elements 102*a*, with the acute angle for 440*a*, can form an elastic wave damping structure having an incident structural grouping of elements. As described hereinabove, the acute angle 440*a* serves to redirect power from the seismic wave 114 around (below) the elements 102*a*. Where a depth 119 of the elements 102*a* (illustrated in FIG. 1B) is sufficiently large, and where the elements extend sufficiently below and toward the protection zone 112, the elements can attenuate power from the wave 114 that reaches the protection zone. Preferred dimensions and orientation of the elements 102*a-b* can be understood, in part, by reference to an acoustic "muffler" described hereinafter in connection with FIG. 12.

The elements 102*a* also include an optional structural lining 439 between the inner volume of the element and the exterior of the element (the earth 118). Structural linings may be helpful when used in certain types of earth where there is danger of the structural elements collapsing, or where there is danger of the structural elements filling with water in an undesirable matter, for example. Such structural linings can include PVC, other types of plastic, metal jackets, or any other suitable type of lining material known in the art of civil and mechanical engineering, for example.

While an incident structural grouping, such as the grouping 434*a*, can provide some protection, it may be useful to include the transmission structural grouping of elements 434*b*, which is optional. The grouping 434*b* includes elements 102*b*, with a line 438*b* extending from the upper end thereof to the lower end thereof forming an obtuse angle 440*b* with the line 436 defining the direction of travel of the elastic wave. In this way, an upper aperture and a lower aperture are formed, with the protection zone 112 at the upper aperture. The lower aperture is smaller than the upper aperture, thus preventing leakage of seismic power up into the protection zone 112. It should be understood that, while the incident structural grouping 434*a* is oriented with successive elements oriented along the X direction, arrays of elements oriented along the Y direction, such as those illustrated in FIGS. 2B and 2D-F provide further advantages, including wider protection zones.

While a superstructure is not specifically annotated in FIG. 4A, it should be understood that the incident grouping 434*a* and transmission grouping 434*b* together can be considered to form a superstructure 435. Such a superstructure is particularly well suited to preventing power from incident waves from entering the protection zone 112. Combinations of incident and transmission groupings of elements can significantly reduce a depth to which borehole or other elements need to be drilled in order to reduce seismic power by a given amount. This has significant cost advantages, as increasing bore depths are significantly expensive. In many embodiments, significant attenuation, such as 34 dB of attenuation, is expected, even where depths of lower apertures in the earth, or below the surface of water, are only on the order of 100 m, for example. The incident structural grouping 434*a* and optional transmission grouping 434*b* together form a superstructure 435.

Figure 4B:
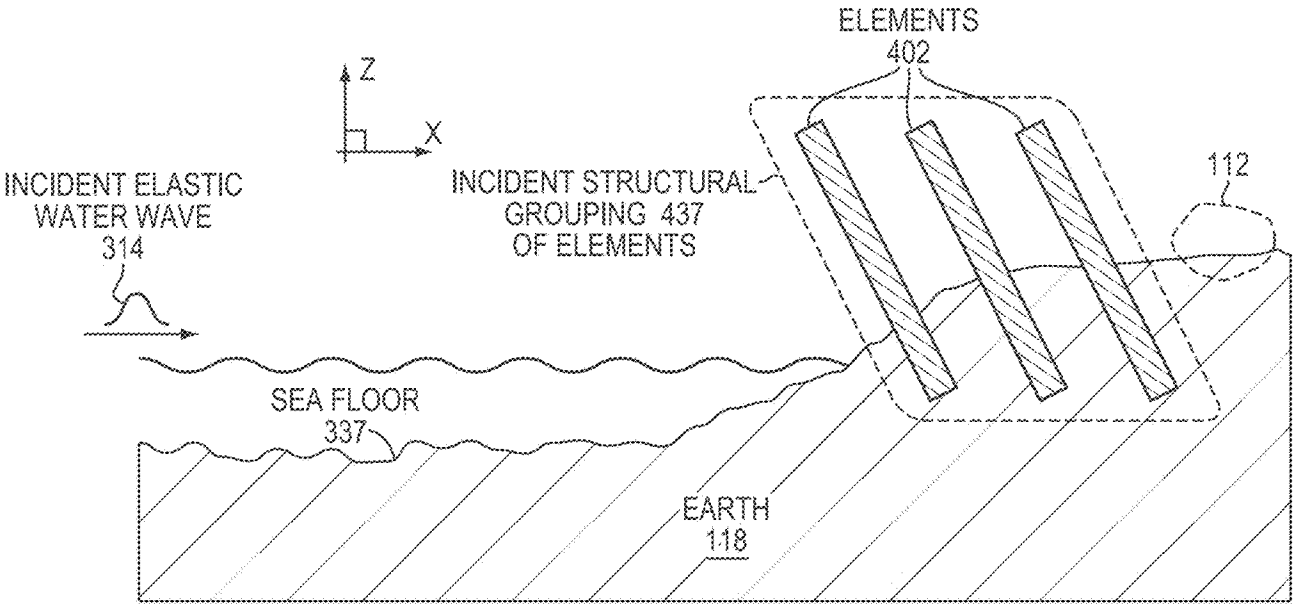
FIG. 4B is a cross-sectional, side-view illustration of an incident structural grouping of elements that can be employed to protect against incident water waves, such as tsunami waves.

FIG. 4B is a cross-sectional side-view illustration of an incident structural grouping 437 of elements 402 that can be employed to protect against incident elastic water waves 314, such as a tsunami wave. The elements 402 are anchored into the earth 118 near a shore of the sea expected to receive an incident wave. The elements 402 can be solid, similar to the elements 302*a* and 302*b* illustrated in FIG. 3, for example.

Figure 7:
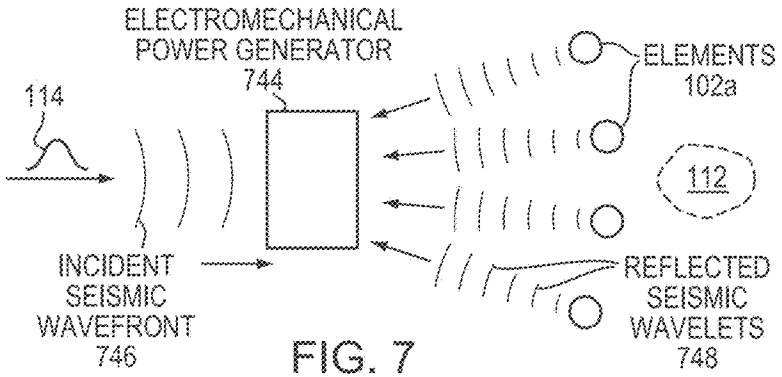
FIG. 7 is a top-view illustration of an additional incident structural grouping of elements showing interference between reflected wavelets and showing constructive interference used to generate electrical power.
Figure 6:
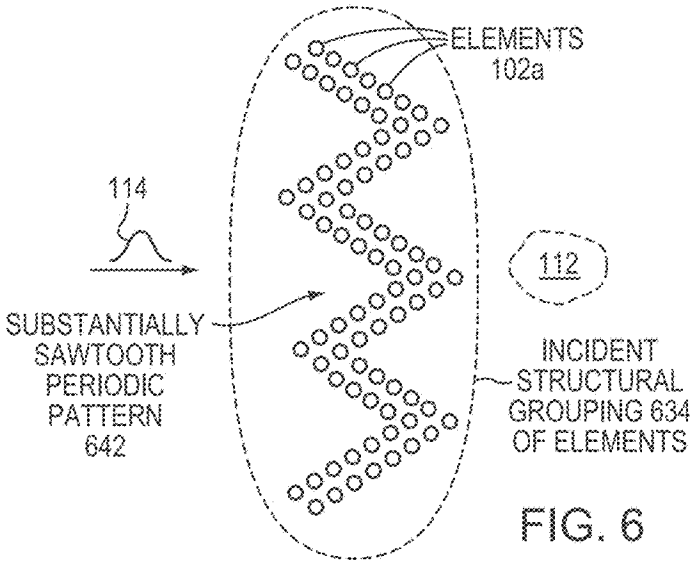
FIG. 6 is a top-view illustration of an embodiment wave damping structure with a substantially sawtooth, substantially periodic pattern of elements that form an incident structural grouping.
Figure 5:
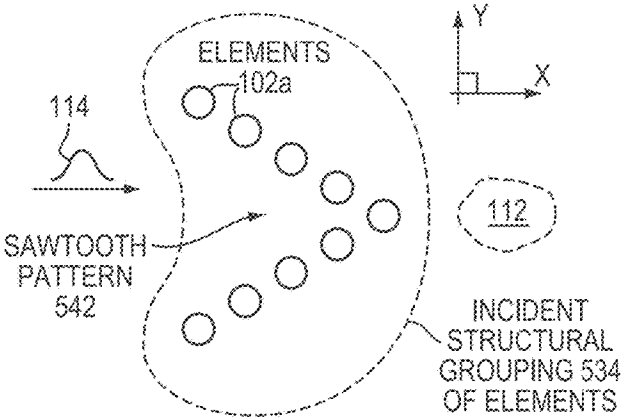
FIG. 5 is a top-view illustration of an arrangement of elements forming an incident structural grouping of the elements in a sawtooth pattern.

FIGS. 5-7 are top-view illustrations of additional incident structural groupings of elements with different configurations and functions. It should be understood that optional transmission-side structural groupings of elements can have similar configurations and may form part of other embodiment elastic wave damping structures, even though transmission groupings are not illustrated in FIGS. 5-7.

FIG. 5 is a top-view illustration of an arrangement of elements 102*a* forming an incident structural grouping 534 of the elements in a sawtooth pattern 542. The incident structural grouping 534 is arranged between the incoming, expected incident seismic wave 114 and the protection zone 112. As described hereinafter in connection with FIG. 9E, for example, substantially sawtooth-type groupings of elements can be situated on both the incident side of the protection zone at which the anticipated seismic wave is expected to the incident, and also on the transmission side of the protection zone, the side of the protection zone opposite the incident side. Thus, with sawtooth-type grouping of elements on both sides of the protection zone, elements from respective groupings can form one or more structural arrangements similar to the arrangement 100 in FIG. 1B. Therefore, superstructures including sawtooth-type groupings, just as superstructures including element rows or element array-type groupings, can also have the significant advantage of providing relatively broadband protection against incident seismic waves.

FIG. 6 is a top-view illustration of a substantially sawtooth periodic pattern 642 of elements 102*a* that form an incident structural grouping 634 of elements.

The substantially periodic, substantially sawtooth pattern 642 has the additional advantage of including more than a single row of elements in order to provide additional attenuation. Furthermore, the multiple-sawtooth pattern can extend a greater width along the y-axis, for example, thus providing a wider protection zone 112.

FIG. 7 is a top-view illustration of an additional incident structural grouping of elements 102*a* that illustrates interference of reflected wavelets from the elements of a grouping. In particular, the seismic wave 114 impinges on the incident grouping of elements 102*a* with an incident seismic wavefront 746. As is understood in the art of wave mechanics, the respective elements 102*a* will reflect some of the seismic power incident on them in the form of seismic wavelets 748. The reflected seismic wavelet 748 from the respective elements 102*a* will interfere with each other, either constructively or destructively in various positions that depend on separation of the elements 102*a*, as well as the wavelength of the incident seismic wave.

The reflected seismic wavelength wavelets 748 also can interfere constructively or destructively with the incident seismic wave 114, creating zones of the incident region in which seismic power is potentially greater than that which is incident, and also regions in which incident and reflected waves destructively interfere with each other to diminish significantly the intensity of seismic waves that are present in a given position. This effect can be exploited to protect certain positions on the incident side of the protection zone 112 having elements that are desired to be protected.

Interference effects can also be exploited advantageously to generate electrical power electro-mechanically. In particular, as illustrated in FIG. 7, an electromechanical power generator 744 is located at a position of expected constructive interference between the incident and reflected waves, such that the magnified mechanical power from the waves is converted into electrical power in order to provide power during a power outage due to an earthquake causing the seismic wave, for example.

Finite element modeling has been employed to predict attenuation of waves of various embodiments seismic wave damping structures. FIGS. 8A-8C, 9A-9B, and 9C-9D illustrate some of these methods and results.

FIG. 8A is a top-view illustration of a protection zone 112 formed between model borehole elements 802*a* and 802*b*. The model borehole elements 802*a* are arranged in element rows and include an incident grouping of elements 834*a*. Similarly, the modeled elements 802*b* are arranged in rows on the opposite side of the protection zone from the incident grouping to form a transmission grouping 834*b*. As also illustrated in FIG. 8A, a 3D section of earth with a array of the borehole elements 802*a* therein is an example of a "metamaterial" as used herein.

FIG. 8B is a three-dimensional (3D) illustration of what is shown in FIG. 8A. In particular, it is noted that the incident grouping 834*a* of elements 802*a*, together with the transmission grouping of elements 802*b*, form a superstructure 840, with the protection zone 112 there between. Individual locations in the 3D meshing represent points used for the finite element analysis.

FIG. 8C is a 3D view of trench elements 803*a* and 803*b* in a 3D finite element meshing. The modeled trench element 803*a* is similar to one or more of the trench elements 203*a* illustrated in FIG. 2F. Likewise, the modeled trench element 803*b* is similar to one or more of the trench elements 203*b* illustrated in FIG. 2F.

The finite element analysis performed on the analytical models illustrated in FIGS. 8A-8C indicate that the borehole based seismic wave damping structure of FIGS. 8A-8B, and the trench-based seismic wave damping structure illustrated in FIG. 8C reduce direct seismic wave power reaching the protection zone by more than 40 dB. It is noted that a diffractive component upwelling through the V-shaped structure has been calculated to be 22 dB lower than the peak seismic wave power observed for the same location in the protection zone without the implementation of the damping structures.

Figure 9B:
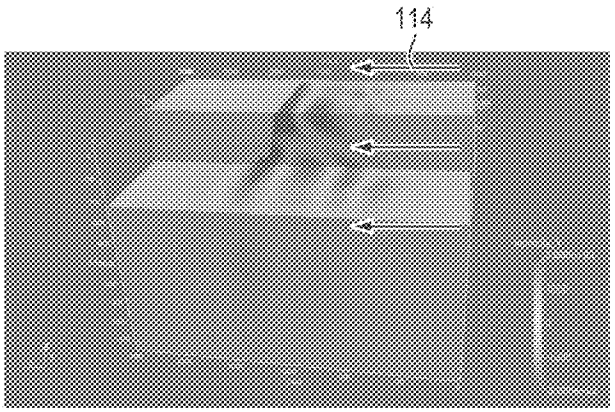
FIG. 9B is a 3D representation of the finite element analysis.
Figure 9A:
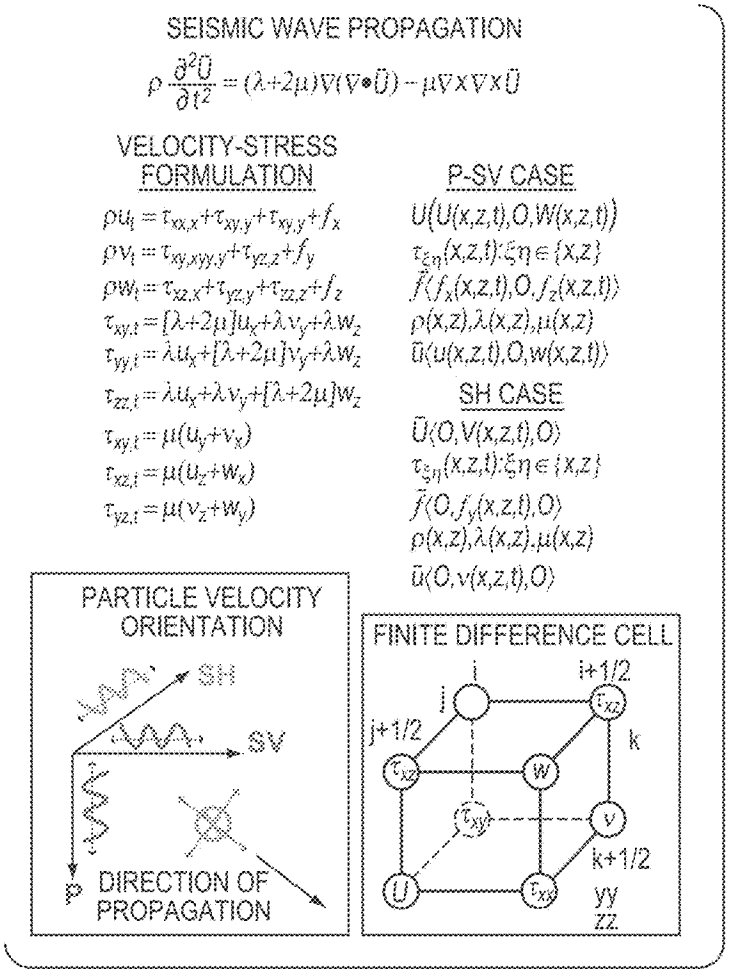
FIG. 9A shows model equations used in finite element analysis of embodiments.

FIG. 9B is a 3D representation of the finite element analysis, with the direction of the incident wave 114 shown.

Figure 9C:
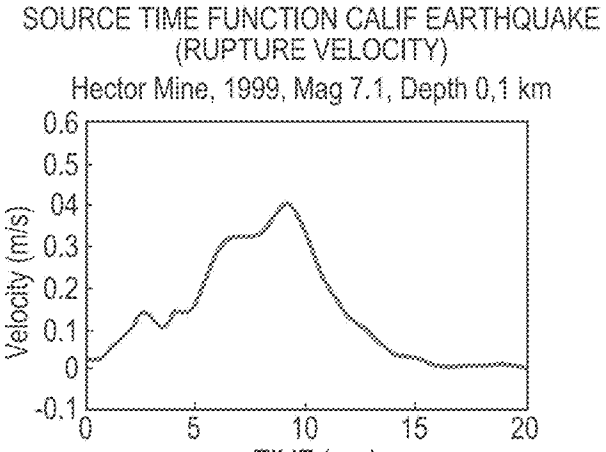
FIG. 9C is a graph showing a source time function for rupture velocity of an earthquake measured and used as a source time function for the finite element analysis.

FIG. 9C is a graph showing a source time function for rupture velocity of an earthquake measured in California in 1991. This source time function was used as input to the finite element analysis. The seismic event is modeled for the response of the source function estimated for the Hector Mine earthquake in 1991 (Magnitude 7.1—USGS). Typical seismic frequencies are less than 1 Hz with minimal power above 1 Hz.

Figure 9D:
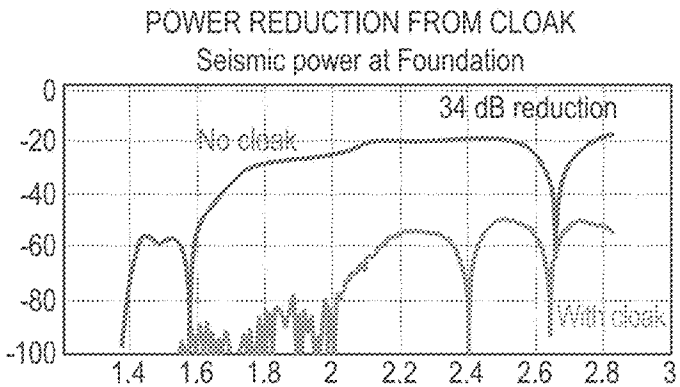
FIG. 9D is a graph showing power reduction calculated in a protection zone with and without embodiment wave damping structures.
Figure 9E:
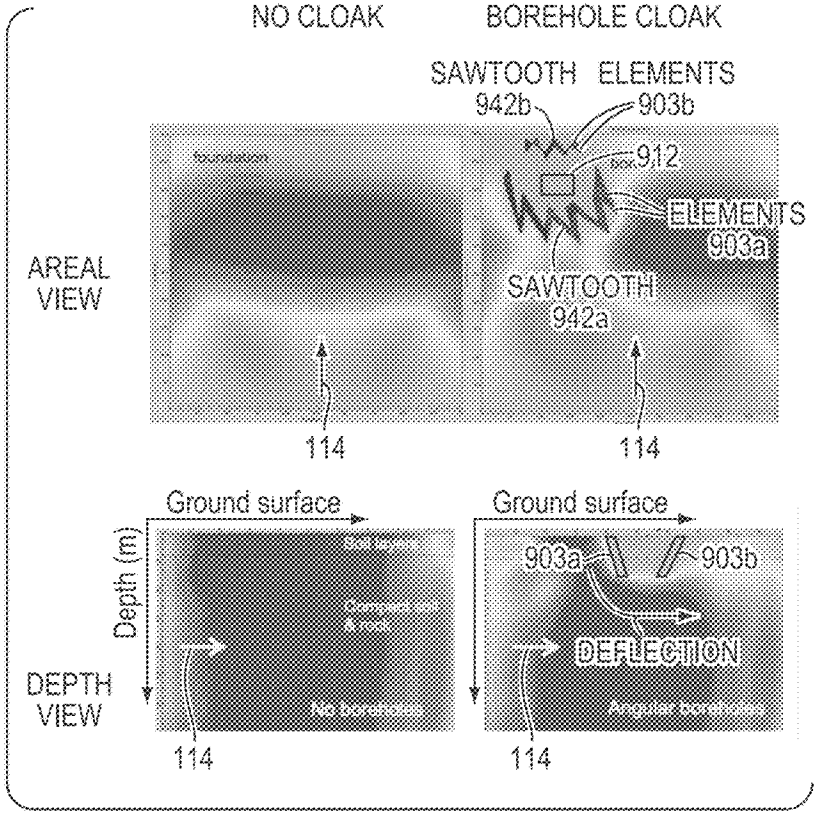
FIG. 9E is collection of areal and depth view seismic wave snapshots calculated with and without embodiment seismic wave damping structures.

FIG. 9D is a graph showing power reduction calculated in a foundation 912, both with and without the borehole cloak (substantially sawtooth periodic pattern superstructure illustrated in FIG. 9E formed of elements 903*a* in a substantially sawtooth 942*a* grouping and elements 903*b* in a substantially sawtooth 942*b* grouping).

FIG. 9E is collection of areal and depth view seismic wave snapshots calculated with and without embodiment seismic wave damping (cloaking) structures, providing a finite difference model of the effects on seismic wave propagation from seismic cloaking. In particular, the top row shows an areal view of seismic wave snapshots, with and without cloaking structures. The bottom row shows a depth view of seismic wave snapshots, with and without cloaking structures.

FIG. 9E illustrates that using a single vertical borehole array or trench may significantly reduce the surface wave power reaching a protected region. However, seismic power is able to be directed by diffraction around the barrier. Using a V-shaped muffler (sawtooth) design is, therefore, much more effective in blocking surface waves in the 3D extent.

FIG. 10 is a table showing various high-value assets that may be protected, as examples, using embodiment elastic wave damping structures. FIG. 10 also shows an expected upper aperture widths (see, e.g., upper aperture 804 in FIG. 8B) and lateral extents (see, e.g., lateral extent 805 in FIG. 8A) of a damping structure for each example asset, with a corresponding, example number of boreholes that is expected to be effective in significantly attenuating seismic power within a protection zone, such as the protection zone 112 in FIGS. 8A-8B, including the asset.

Superstructures as described herein, and as exemplified by the superstructure 840 in FIG. 8B, can divert, attenuate, and create destructive interference of hazardous seismic waves that would otherwise reach a high valued asset such as the assets listed in FIG. 10. Example superstructures, also referred to herein a cloaking arrays, may be 50-200 meters wide (in upper aperture), and hundreds of meters to a few kilometers in lateral extent depending on protected asset size and risk. An example, single borehole diameter can be 1 meter for the structures listed in FIG. 10, where 400 boreholes can populate an example 100 square meter region. For most applications, borehole depths can be an estimated 150 meters or less. These depths can be particularly relevant where surface seismic waves are of greatest concern.

Figure 11:
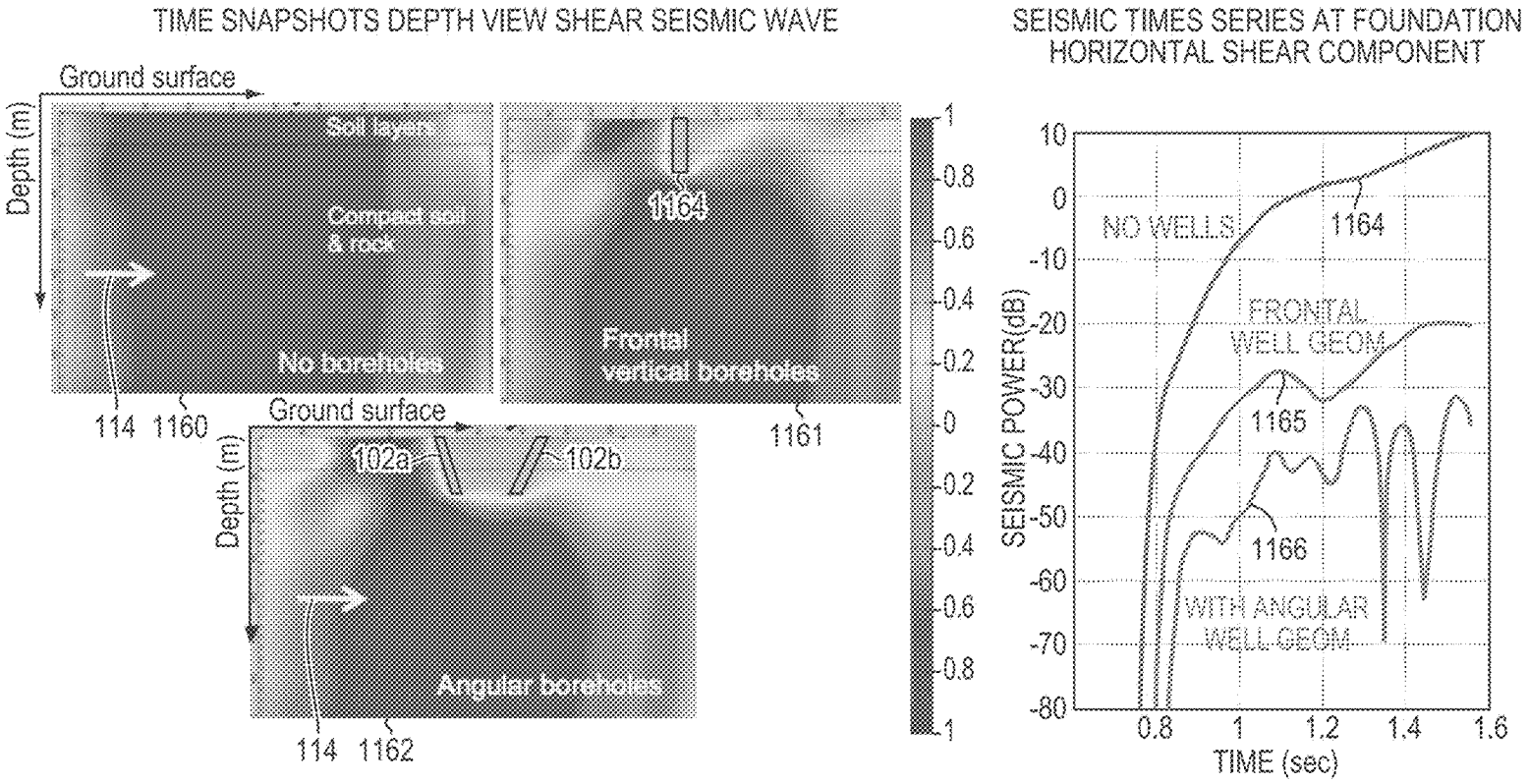
FIG. 11 is a series of diagrams and a graph showing the comparative effects of seismic cloaking on seismic wave propagation for a single, vertical barrier element compared with an embodiment angled structural element, as calculated using a finite difference 2D model of the barrier structures.

FIG. 11 is a series of diagrams 1160-1162, and a graph 1163, showing the comparative effects of seismic cloaking generally on seismic wave propagation for a single, vertical barrier element compared with an embodiment structural element, as calculated using a finite difference 2D model of the barrier structures. The seismic event is modeled for the response of the source function estimated for the Hector Mine earthquake in 1991 (Mag. 7.1—USGS), as illustrated in FIG. 9C. Typical seismic frequencies are less than 1 Hz, with minimal power above 1 Hz.

In particular, the diagram 1160 shows an areal view of seismic wave snapshots without cloaking, while the diagram 1161 shows the effect of a single, frontal vertical borehole 1164. Further, the diagram 1162 is a depth view snapshot of the effect of cloaking using a structural arrangement including two angled borehole elements 102*a*, 102*b* as described in relation to FIG. 1B.

As illustrated in the comparison, using a single vertical borehole array or trench may significantly reduce the direct surface wave energy reaching a protected region. However, energy is still able to diffract around the barrier and enter the protected region. Using a V-shaped muffler (structural arrangement) formed of elements 102*a* and 102*b* is much more effective in blocking surface waves in the 3D extent. The graph 1163 of seismic power as a function of time reaching the protection zone further bears out this fact. A curve 1164 corresponds to graph 1160, with no boreholes and the highest power; a curve 1165 corresponds to graph 1161 with one vertical borehole and somewhat diminished power reaching the protection zone. However, a curve 1166 corresponds to the angled boreholes case of graph 1162, with greatly diminished power entering the protection zone between the angular boreholes.

Figures 12A, 12B:
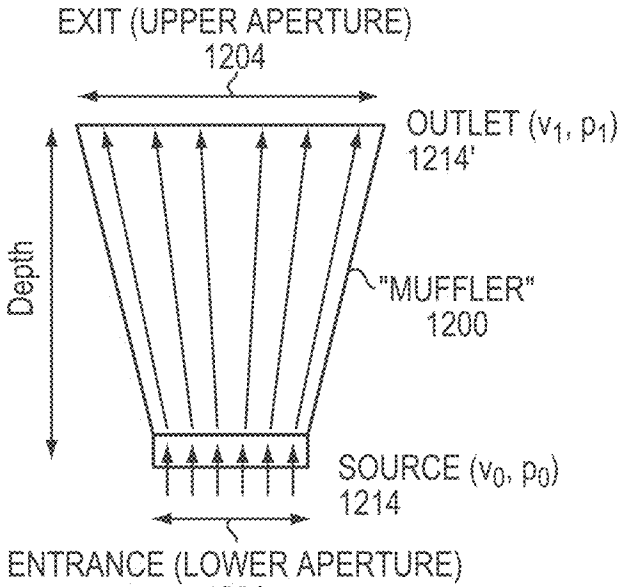
FIGS. 12A-12B show a diagram and equations illustrating semi-analytical simulation of acoustic propagation through a "tapered muffler" geometry.

FIGS. 12A-12B are a diagram and equations illustrating semi-analytical simulation of acoustic propagation through a "tapered muffler" 1200 geometry. The tapered muffler 1200 and associated equations can be found in Easwaran and Munj al, J. Sound and Vibration 152 (1992), 73-93 and can be used as part of understanding the efficacy of embodiment structural arrangements, such as the arrangement 100 illustrated in FIG. 1B, in proving a barrier against seismic waves.

The muffler 1200 includes a tapered funnel with a sub-wavelength opening (entrance; lower aperture) 1206 with respect to a wavelength of an acoustic radiation source 1214. The mathematical expressions shown in FIG. 12B provide a simple, analytical, transfer matrix approach to evaluating energy attenuation as a function of the entrance 1206, an exit (upper aperture) 1204, a depth 1219, and related angle dimensions.

Figure 13B:
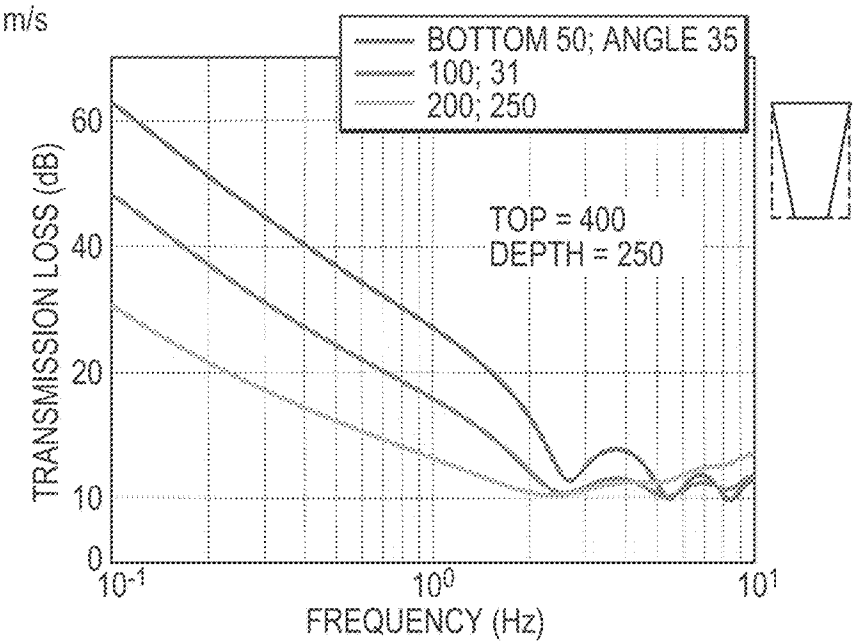
FIGS. 13A and 13B are graphs showing transmission loss as a function of frequency for various acoustic "muffler" parameters, as calculated using the analytical tools shown in FIGS. 12A-12B.
Figure 13A:
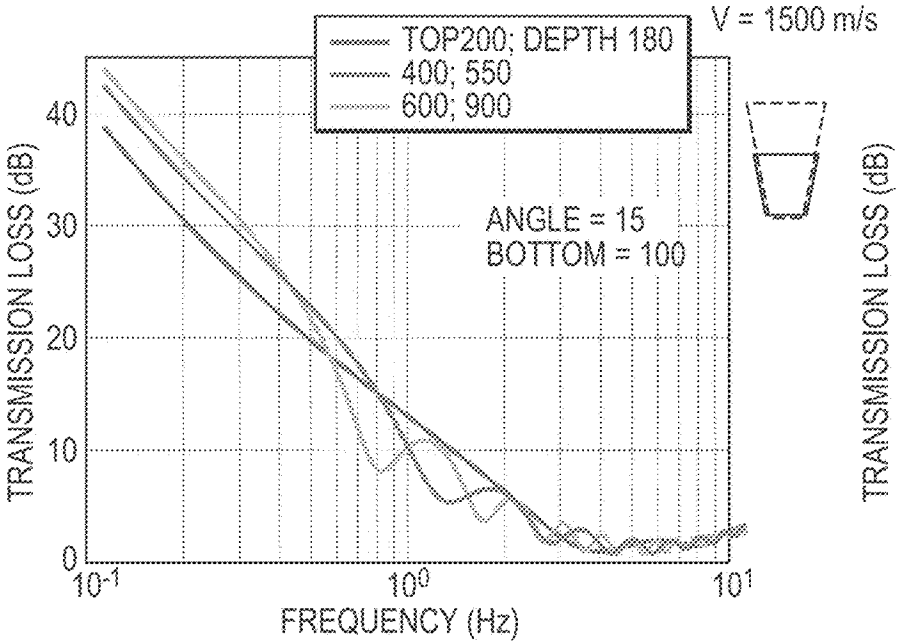

FIGS. 13A and 13B are graphs showing transmission loss as a function of frequency for various acoustic "muffler" parameters assuming a wave speed of 1500 meters per second (m/s). The calculations were performed using the analytical tools shown in FIGS. 12A-12B in order to at least begin to understand optimization of parameters for structural arrangements such as the arrangement 100 in FIG. 1B.

In general, the calculations for mufflers suggest that small entrance, shallow depth and steep angle can all help to maximize attenuation of acoustic waves incident at the entrance aperture. Specific trends observed in calculations such as those shown in FIGS. 13A-13B include: (i) Increasing the depth at constant angle increases attenuation at the lower frequencies, but reduces attenuation at the higher frequency due to multiple nodes; (ii) Increasing the depth at constant top & bottom aperture dimensions (i.e., while reducing the angle) reduces attenuation across the entire frequency range; and (iii) Increasing the bottom aperture opening reduces attenuation across the entire frequency range. These trends can be applied advantageously to design of structural apertures for seismic wave attenuation in embodiment elastic wave damping structures in order to maximize seismic wave attenuation.

Figure 14:
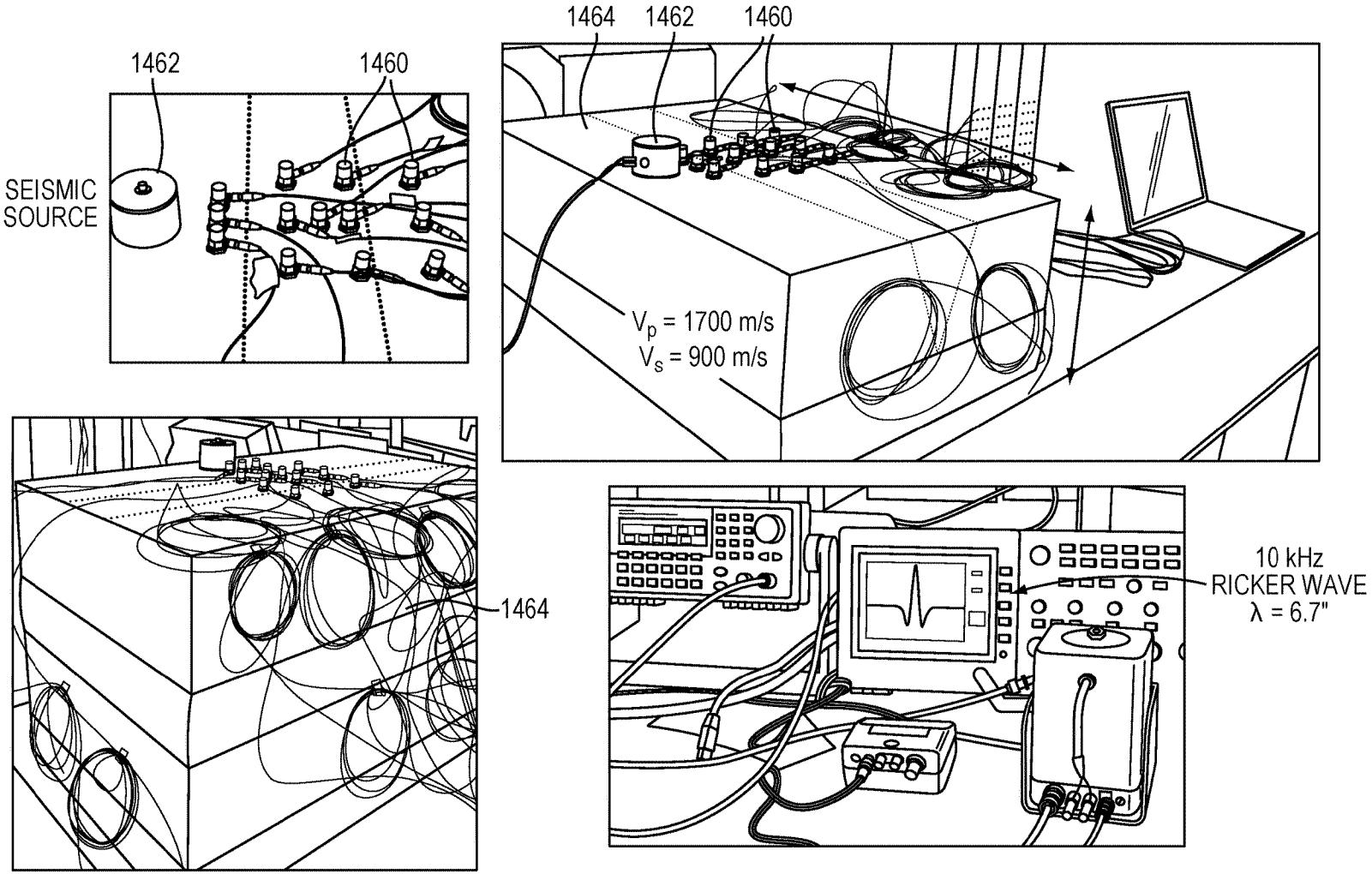
FIG. 14 is a collage of photographs showing apparatus used to study, on a model scale, non-naturally occurring, man-made structures such as borehole arrays and trenches embedded in elastic media analogous to rock and compact soil using a machined, table-top scaled physical model.

FIG. 14 is a collage of photographs showing apparatus used to study, on a model scale, non-naturally occurring, man-made structures such as borehole arrays and trenches embedded in elastic media analogous to rock and compact soil using a machined table-top scaled physical model. The effort focused on examining the effects of borehole arrays and trenches (metamaterials) on seismic wave propagation, diversion, scattering, and attenuation through spatial measurements from controlled seismic sources. The time series measurements were then compared and analyzed with computer model simulations.

The solid model was composed of Delrin® plastic 1464 with a P-wave speed of 1700 m/s, S-Wave speed of 855 m/s, and a density of 1.41 g/cm3. Delrin® blocks were machined to contain boreholes in prescribed patterns or trenches defining a V-shaped muffler and compared with homogeneous solid blocks. The Delrin® blocks contained boreholes in prescribed patterns or trenches defining a V-shaped muffler.

The model muffler was aimed at significantly reducing the elastic wave power reaching a 'protected keep-out'zone from a controlled elastic wave source. Each borehole had a diameter of 3 mm and was separated 3 mm apart from neighboring boreholes, forming a single line, where the line extended the entire length of the block. A near and far borehole line V-shaped pattern was formed where the near and far borehole line spacing is 3 inches apart on the Delrin® surface, the boreholes are sloped with a 5 inch length (4 inch vertical depth), and provided an aperture opening at the V-borehole barrier structure base of 0.5 inches.

Similarly, a V-trench barrier structure was machined in a separate Delrin® block where the 3 mm diameter boreholes were in contact, forming continuous hollow walls on both sides of the barrier structure. A Modal-Shop® variable transducer 1462 was used to vertically load on the Delrin® block surface to prescribed loading functions. A 10 kHz Ricker waveform was used to act as the seismic input function to generate the elastic wave propagation in the Delrin® blocks. PCB® model 352C33 accelerometers 1460 were used to measure the temporal and spatial vibration distributions observed on the Delrin® surface. An IOTECH® wavebook 516E was used to record each time series trace using a synchronized 70 kHz sample rate per channel.

Figure 15A:
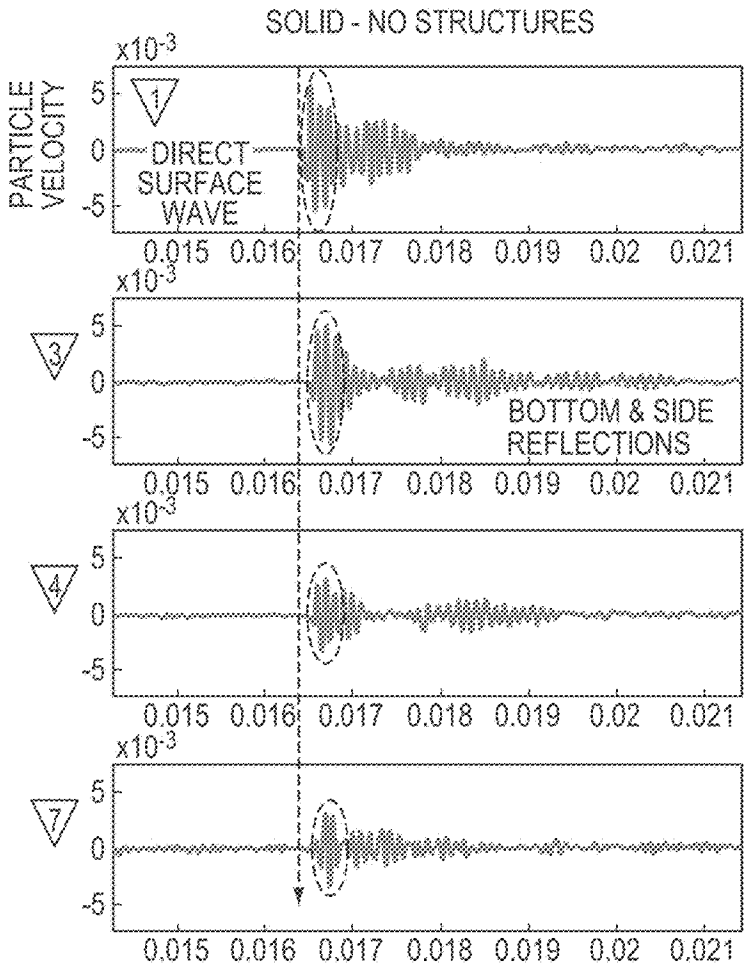
Figure 15B:
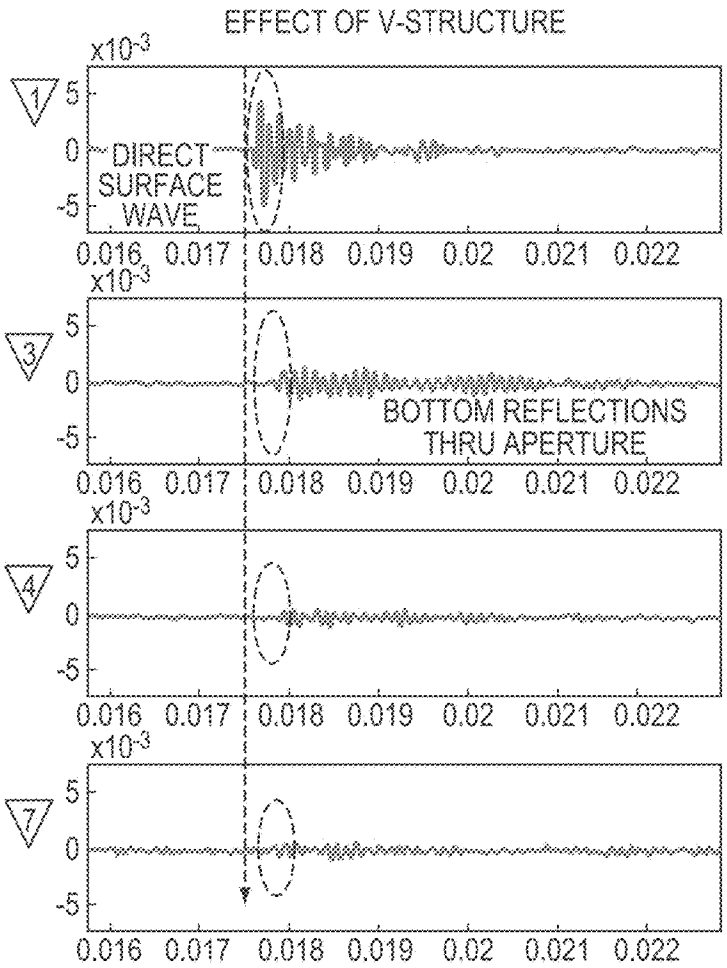

FIGS. 15A-15C show measured results that illustrate the effects of a model V-trench machined in Delrin® block table-top experimental configuration. FIG. 15A shows four accelerometer time series traces measured in a center line across a homogeneous solid Delrin® block relative to the transducer source location. Receivers 1, 3, 4, and 7 were 1, 3, 4, and 7 inches from the source, respectively. Particle velocities were computed by integrating the measured accelerations and then applying a high-pass filter to remove low frequency drift. A single 10 kHz Ricker vertical load burst was recorded as it traveled from its source. Each trace records a similar time series, showing a direct surface wave arrival (circled outline) followed by later reflection arrival interference from the Delrin® block side and bottom boundaries. The first break of the direct arrivals shows a wave speed of 1693 m/s. Spherical spreading and Delrin® attenuation losses are not compensated in the measurement plots. At the observed wave speed, the P-wavelength was estimated at 17 mm.

FIG. 15B shows four accelerometer time series traces measured in the center line across the Delrin® block that contains a V-trench barrier structure perpendicularly oriented to the direction of elastic wave propagation relative to the transducer source location. Receivers 1, 3, 4, and 7 were 1, 3, 4, and 7 inches from the source, respectively, where receivers 3 and 4 were between the near and far trench walls.

FIG. 15C shows the trench barrier structure in schematic form. The times series traces show that the direct surface wave is reflected off the near trench wall, where very little direct wave is observed inside the keep out zone between the near and far trench walls. The reflected arrival interference from the bottom surface is observed at the surface between the trench walls. In this geometry, elastic waves were able to leak through the aperture at the trench bottom and travel to the surface. These amplitudes, however, are lower than those of the peak surface wave that would be observed in the same locations if the barrier cloaking structure were not present.

FIG. 16 shows earthquake magnitude reduction expected due to subsurface barrier structures, based on extrapolation from the measured and modelled results. In this simple analysis, the power drop observed in the measurement and model studies are presented in terms of Mw reduction. The V-trench structure shows that a magnitude 7.0 earthquake energy intensity can be reduced to 5.4-5.0 for the peak power of the direct destructive surface wave. The leakage through the aperture is measured to show a modest reduction. However, when modeling the earth, where the boundaries are infinite, diffraction leakage through the aperture is small, and the structure would be expected provide a significant reduction in wave energy. Notably, modeled and measured Delrin® block waveforms and amplitudes agreed within 3 dB The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A seismic wave damping structure comprising:

A structural arrangement of at least two elements, each element defining an inner volume and containing therein a medium resistant to passage of an anticipated seismic wave in earth having a wavelength at least one order of magnitude greater than a cross-sectional dimension of the inner volume of the elements;

Wherein the medium resistant to passage of an anticipated seismic wave in earth is at least one of air, gas, water, or viscous fluid; and The structural arrangement tapering from an upper aperture to a lower aperture, the structural arrangement defining a protection zone at the upper aperture, and wherein the structural arrangement is configured to attenuate power from the anticipated seismic wave within the protection zone relative to power from the anticipated seismic wave external to the protection zone.

2. The damping structure of claim 1, wherein the structural arrangement is further configured to attenuate power from a Rayleigh seismic wave.

3. The damping structure of claim 1, wherein the structural arrangement is further configured to attenuate power from at least one of a compression, shear, or Love seismic wave.

4. The damping structure of claim 1, wherein the at least two elements are boreholes in earth, and wherein the upper aperture is closer to a surface of the earth than the lower aperture.

5. The damping structure of claim 1, wherein the at least two elements are trenches in earth, and wherein the upper aperture is closer to a surface of the earth than the lower aperture.

6. The damping structure of claim 1, wherein a depth of the lower aperture in earth is on the order of 100 meters.

7. The damping structure of claim 1, wherein each element further includes a structural lining between the inner volume and an exterior of the element.

8. The damping structure of claim 1, wherein a length of the upper aperture is on the order of 0.5 km.

9. The damping structure of claim 1, wherein each of the at least two elements comprises a plurality of discreet sub-elements, each of the sub-elements defining a respective sub-element inner volume and containing therein the medium resistant to passage of the seismic wave.

10. The damping structure of claim 9, wherein cross-sections of respective discreet sub-elements corresponding to at least one of the elements are located at points collectively defining a hexagon.

11. The damping structure of claim 1, further comprising a plurality of structural arrangements defining a superstructure, and wherein the protection zone encompasses, at least partially, upper apertures of respective arrangements of the plurality of structural arrangements, the superstructure configured to attenuate power from the seismic wave within the protection zone relative to power from the seismic wave external to the protection zone.

12. The damping structure of claim 1, wherein the protection zone extends, in length, from one of the at least two elements to the other at the upper aperture, and wherein the protection zone has a width, measured perpendicular to the length, of approximately 5%, 10%, 25%, 50%, 75%, or 100% of the length.

13. The damping structure of claim 1, wherein the protection zone is defined by a region, bounded at least partially by the at least two elements, within which the structural arrangement is configured to attenuate power from the seismic wave by at least 10 dB within the protection zone relative to power from the seismic wave external to the protection zone.

14. The damping structure of claim 1, further including:

an incident grouping of elements situated at a border of the protection zone expected to receive the seismic wave; and a transmission grouping of elements situated at a border of the protection zone opposite the incident grouping, wherein the structural arrangement of at least two elements includes one element of the incident grouping and one element of the transmission grouping, wherein each element of the incident and transmission groupings of elements has upper and lower ends thereof, wherein each element of the incident and transmission groupings of elements defines an inner volume and contains therein the medium resistant to passage of the anticipated seismic wave, and wherein the incident and transmission groupings form a superstructure.

15. The damping structure of claim 14, wherein upper ends or lower ends of respective elements of the incident or transmission grouping are situated along an element row.

16. The damping structure of claim 15, wherein upper ends or lower ends of respective elements of the incident or transmission grouping are further situated along a plurality of substantially parallel rows to form an element array.

17. The damping structure of claim 14, wherein upper ends or lower ends of respective elements of the incident or transmission grouping are situated to form a substantially periodic pattern.

18. The damping structure of claim 17, wherein the substantially periodic pattern is a substantially sawtooth pattern.

19. The damping structure of claim 17, wherein the substantially periodic pattern is configured to cause constructive or destructive interference of diffracted portions of the anticipated seismic wave diffracted from respective elements.

20. The damping structure of claim 1, further including an electro-mechanical generator configured to generate or store electrical power using mechanical power from the anticipated seismic wave.

21. The seismic wave damping structure of claim 1, wherein the at least two elements are boreholes, and wherein the cross-sectional dimension of the inner volume of the elements is a diameter of the elements.

22. The seismic wave damping structure of claim 1, wherein the medium resistant to passage of the anticipated seismic wave fills the inner volume of each of the at least two elements.

23. A seismic wave damping structure comprising:

A structural grouping of elements defining a border of a protection zone, each element of the structural grouping defining an inner volume and containing therein a medium resistant to passage of an anticipated seismic wave in earth having a wavelength at least one order of magnitude greater than a cross-sectional dimension of the inner volume of the elements;

Wherein the medium resistant to passage of an anticipated seismic wave in earth is at least one of air, gas, water, or viscous fluid;

Each element of the structural grouping having an upper end and a lower end thereof defining a first line from the upper end to the lower end, the first line forming an acute angle with a second line defining a direction of travel of the anticipated seismic wave toward the protection zone; and The structural grouping of elements configured to attenuate power from the seismic wave within the protection zone relative to power from the seismic wave external to the protection zone.

24. The damping structure of claim 23, wherein the grouping of elements is further configured to attenuate power from a Rayleigh seismic wave.

25. The damping structure of claim 23, wherein the grouping of elements is further configured to attenuate power from at least one of a compression, shear, or Love seismic wave.

26. The damping structure of claim 23, wherein each element is a borehole in earth, with the upper end closer to a surface of the earth than the lower end.

27. The damping structure of claim 23, wherein each element is a trench in earth, with the upper end closer to a surface of the earth than the lower end.

28. The damping structure of claim 23, wherein a depth of each element in earth is on the order of 100 meters.

29. The damping structure of claim 23, wherein at least one of the elements comprises a plurality of discreet sub-elements substantially parallel to each other, each of the sub-elements defining a respective sub-element inner volume and containing therein the medium resistant to passage of the seismic wave.

30. The damping structure of claim 29, wherein cross-sections of respective discreet sub-elements are located at points in a cross-sectional plane collectively defining a hexagon.

31. The damping structure of claim 23, wherein upper ends or lower ends of respective elements are situated along an element row.

32. The damping structure of claim 31, wherein upper ends or lower ends of respective elements are further situated along a plurality of substantially parallel rows to form an element array.

33. The damping structure of claim 23, wherein upper ends or lower ends of respective elements are situated in the structural grouping to form a substantially periodic pattern.

34. The damping structure of claim 33, wherein the substantially periodic pattern is a substantially sawtooth pattern.

35. The damping structure of claim 33, wherein the substantially periodic pattern is configured to cause constructive or destructive interference of diffracted portions of the anticipated seismic wave diffracted from respective elements.

36. The damping structure of claim 23, wherein the grouping of elements is an incident grouping of elements situated at a border of the protection zone at which the anticipated seismic wave is expected to be incident, the damping structure further comprising:

a transmission grouping of elements situated at an opposite border of the protection zone opposite the incident grouping, each element of the transmission grouping defining an inner volume and containing therein a medium resistant to passage of the anticipated seismic wave having a wavelength at least one order of magnitude greater than a cross-sectional dimension of the inner volume of the element; and each element of the transmission grouping having an upper end and a lower end thereof defining a first line from the upper end to the lower end, the first line forming an obtuse angle with a second line defining a direction of travel of an attenuated anticipated seismic wave away from the protection zone, wherein the transmission grouping of elements configured to attenuate power from the seismic wave within the protection zone relative to power from the seismic wave external to the protection zone and transmitted through or around the incident grouping of elements.

37. The damping structure of claim 23, wherein a separation of upper ends of elements of the incident grouping from upper ends of respective elements of the transmission grouping is on the order of 0.5 km.

38. The damping structure of claim 23, wherein the protection zone is further defined by a region, bounded at least partially by the incident and transmission groupings, within which the incident and transmission groupings are configured to attenuate power from the seismic wave by at least 10 dB within the protection zone relative to power from the seismic wave external to the protection zone.

* * * * *